US008622539B2

(12) United States Patent
Schwartz et al.

(10) Patent No.: US 8,622,539 B2
(45) Date of Patent: Jan. 7, 2014

(54) TWO-DIMENSIONAL ABSOLUTE POSITION SENSOR AND PROJECTION CONTROL FOR A HANDHELD PRINTER

(75) Inventors: Edward L. Schwartz, Sunnyvale, CA (US); Kenneth F. Gudan, Sunnyvale, CA (US)

(73) Assignee: Ricoh Co., Ltd., Tokyo (JP)

( * ) Notice: Subject to any disclaimer, the term of this patent is extended or adjusted under 35 U.S.C. 154(b) by 786 days.

(21) Appl. No.: 12/616,053

(22) Filed: Nov. 10, 2009

(65) Prior Publication Data

US 2011/0109678 A1 May 12, 2011

(51) Int. Cl.
*B41J 29/38* (2006.01)
*B41J 3/36* (2006.01)

(52) U.S. Cl.
USPC ..... 347/109; 347/14

(58) Field of Classification Search
None
See application file for complete search history.

(56) References Cited

U.S. PATENT DOCUMENTS

| | | | | |
|---|---|---|---|---|
| 5,825,995 | A | 10/1998 | Wiklof et al. | |
| 6,618,078 | B1 * | 9/2003 | Budrys | 348/207.99 |
| 6,846,119 | B2 * | 1/2005 | Walling | 400/88 |
| 7,876,472 | B2 * | 1/2011 | Gudan et al. | 358/1.18 |
| 2002/0154186 | A1 * | 10/2002 | Matsumoto | 347/14 |
| 2003/0043388 | A1 * | 3/2003 | Andrews et al. | 358/1.7 |
| 2004/0027443 | A1 * | 2/2004 | Trent | 347/109 |
| 2004/0233242 | A1 * | 11/2004 | Patton et al. | 347/14 |
| 2007/0076082 | A1 * | 4/2007 | Cook | 347/109 |
| 2007/0139507 | A1 * | 6/2007 | Ahne et al. | 347/109 |
| 2007/0139508 | A1 * | 6/2007 | Muyskens | 347/109 |
| 2007/0147930 | A1 * | 6/2007 | Nishath et al. | 400/88 |
| 2008/0055384 | A1 * | 3/2008 | Noe et al. | 347/109 |
| 2008/0075511 | A1 * | 3/2008 | Reed et al. | 400/88 |
| 2008/0170900 | A1 * | 7/2008 | James et al. | 400/88 |
| 2008/0262719 | A1 * | 10/2008 | Bledsoe et al. | 701/207 |

(Continued)

FOREIGN PATENT DOCUMENTS

| | | |
|---|---|---|
| JP | 9156163 | 6/1997 |
| JP | 10029346 | 2/1998 |
| JP | 2004-106329 | 4/2004 |

OTHER PUBLICATIONS

Japanese Patent Application No. 2007-265847 Office Action dated Jun. 19, 2012, 3 pages.

(Continued)

*Primary Examiner* — Stephen Meier
*Assistant Examiner* — Leonard S Liang
(74) *Attorney, Agent, or Firm* — Patent Law Works LLP

(57) ABSTRACT

A handheld portable printer includes members and a handle that are joined together to form a generally O-shaped device. The members provide a rigid and strong structure and an area for housing a projector to project an image on the print surface of the image to be printed. The bottom member houses a pair of absolute position sensors spaced apart and aligned upon the longitudinal axis on the bottom of the handheld portable printer. A controller is associated with the absolute position sensors to produce precise position information. The controller uses the precise position information to control the projection of the image to be printed and the printing of pixels by the print head. In one embodiment, the print head is controlled such that each pixel is printed at least twice. The present invention also includes a number of novel methods including: a method for printing an image with a handheld printer, a method for projecting an image to be printed, and a method for registering a location of a printer and portions of a printed image.

20 Claims, 17 Drawing Sheets

(56) References Cited

U.S. PATENT DOCUMENTS

| | | | | |
|---|---|---|---|---|
| 2008/0316290 | A1* | 12/2008 | Brown et al. | 347/109 |
| 2009/0040286 | A1* | 2/2009 | Tan et al. | 347/109 |
| 2009/0141112 | A1* | 6/2009 | Bergman et al. | 347/109 |

OTHER PUBLICATIONS

Japanese Patent Application No. 2007-265847 Office Action dated Sep. 11, 2012, 5 pages.

* cited by examiner

TWO-DIMENSIONAL ABSOLUTE POSITION SENSOR AND PROJECTION CONTROL FOR A HANDHELD PRINTER

BACKGROUND OF THE INVENTION

1. Field of the Invention

The present invention relates to printing devices, and in particular, to a handheld portable printer and a method of operation. Still more particularly, the present invention relates to a two-dimensional absolute position sensor and projection control for a handheld printer.

2. Description of the Background Art

Printers are well known in the art and there are a variety of different types such as laser printers, dot-matrix printers and ink jet printers. Each of these printers uses a different type of technology for applying the "ink" to the print media ("paper"). However, most all printers require that the print media be moved past a relatively stationary print head that applies the "ink" to the print media. Print heads on tracks that are constrained to not rotate and only translate along one dimension and print heads that contain optics such as mirrors that rotate are examples. Most often such printers have a housing for holding the print head in a fixed orientation and complex paper handling trays and mechanisms to feed the print media past the print head and render the printed output. Since most printers require such a large housing, such printers are not hand held, but rather large devices significantly greater in size than a standard sheet of 8×11" sheet of paper. While there have been some printers created for a mobile computing environment, such printers often have a print head or print head mechanism that is at least 8.5 inches in length.

There have been attempts in the prior art to provide a hand held printer. These attempts include a typical approach of reducing the size of the print head so that it can be mounted within a portable housing along with electronics, the power supply and other elements of a printer. However, existing hand-held printers have significant limitations. For many existing hand-held printers, the size of the image that they are able to print is severely limited. For example, some prior art printers are able to print only while they are stationary, and thus, are limited to printing images less than or equal to the printer itself or the print head, which in either case is less that a few inches square. This also makes the printer bulky and difficult to use.

Other handheld printers allow printing while the user moves or "swipes" the handheld printer across or over the print media. However, these printers are again limited in at least one dimension in the size of the images they are able to print. Specifically, they are only able to print an image less than or equal to the size of the print head, and most are limited to one pass or swipe. For those handheld printers that are able to print in sections, it is very difficult to align the multiple, separate printing steps, swipes or sections. Moreover, some printers allow images to be printed in multiple sections require special paper, registration marks or require starting printing at an edge boundary. Furthermore, there is a high misprinting or failure rate with such multiple section handheld printers. For example, failure to print the image properly often occurs if the user prematurely removes the printing device from the surface of the print medium.

Another problem in the prior art is that it is very difficult to accurately measure the movement of existing handheld printers and determine when the print head should be activated. Without precise and accurate measurement of the position of the handheld printer, there is significant misalignment between the pixels in the image which results in poor and inconsistent print quality.

SUMMARY OF THE INVENTION

The present invention overcomes the deficiencies and limitations of the prior art by providing a handheld portable printer and a method of operation. In one embodiment, the handheld portable printer includes members and a handle that are joined together to form a generally O-shaped device. The members provide a rigid and strong structure and an area for housing a projector to project an image on the print surface of the image to be printed. The bottom member tapers outward to provide increased stability as the handheld printer is moved across a print medium. The bottom member houses a pair of absolute position sensors spaced apart and aligned upon the longitudinal axis on the bottom of the handheld portable printer. A controller is associated with the absolute position sensors to produce precise position information. The controller uses the precise position information to control the projection of the image to be printed and the printing of pixels by the print head. In one embodiment, the print head is controlled such that each pixel is printed twice if the print head passes over each pixel at least twice. The handle provides additional buttons for inputting commands to lock an image or begin printing, and in one embodiment housing electronics for control and projection of the image to be printed, providing user feedback, and communicating with other devices. The present invention also includes a number of novel methods including: a method for printing an image with a handheld printer, a method for projecting an image to be printed, and a method for registering a location of a printer and portions of a printed image.

BRIEF DESCRIPTION OF THE DRAWINGS

The invention is illustrated by way of example, and not by way of limitation in the figures of the accompanying drawings in which like reference numerals are used to refer to similar elements.

DETAILED DESCRIPTION OF THE PREFERRED EMBODIMENTS

A handheld printer and a method for using same are described. In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention. For example, the present invention is described primarily with reference to printing documents for reading. However, the present invention applies to any type of printing including electronic circuits, partially invisible printing for marking and various other printing techniques.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will be apparent from the description below. In addition, the present invention is not described with reference to any particular programming language. It will be appreciated that a variety of programming languages may be used to implement the teachings of the invention as described herein.

Moreover, the present invention claimed below may operate on or work in conjunction with an information system or network. For example, the invention can operate as a stand alone printer or communicate with a network with additional functionality varying depending on the configuration. Thus, the present invention is capable of operating with any information system from those with minimal functionality to those providing all the functionality disclosed herein.

Figure 1:
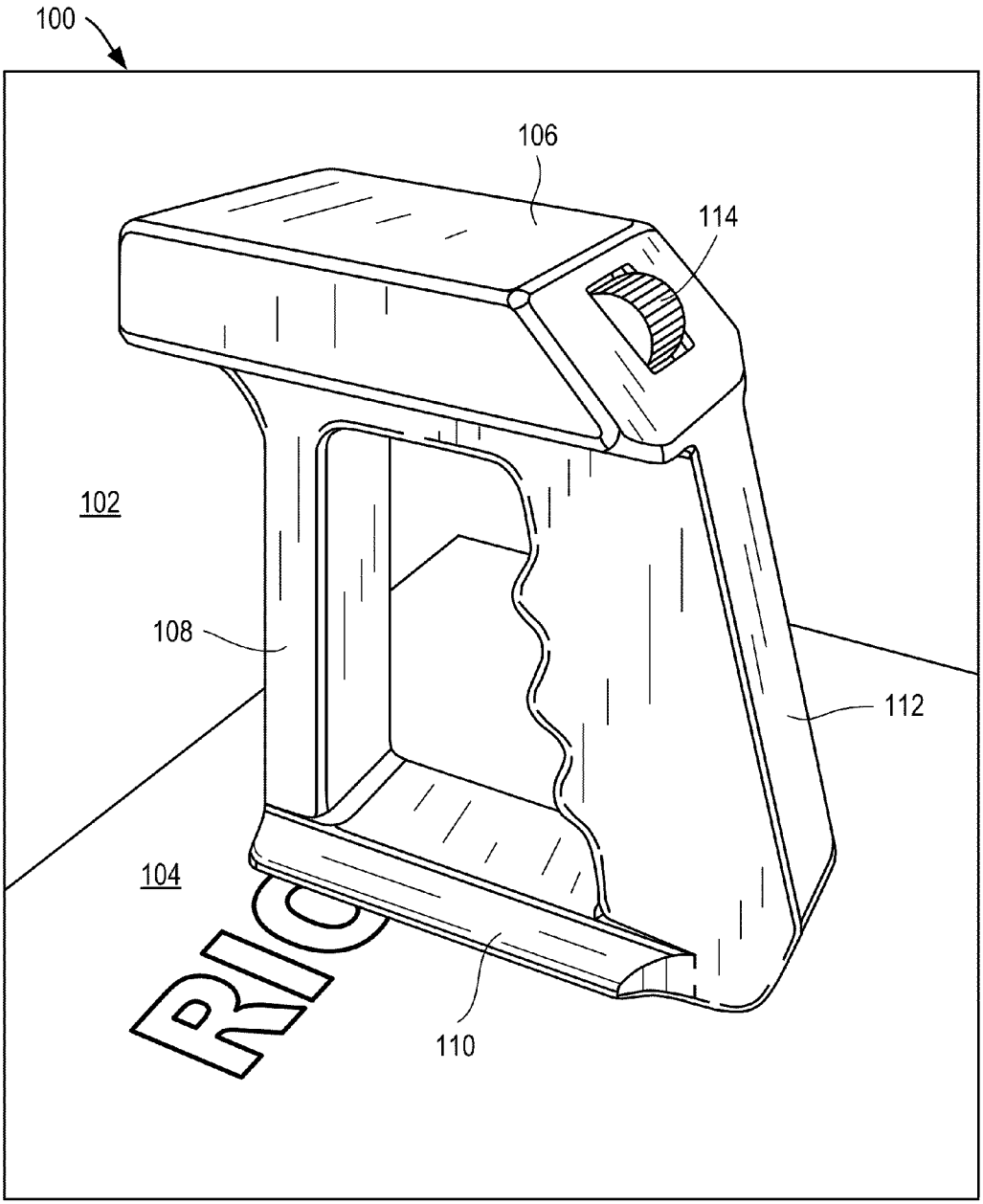
FIG. 1 is an upper, rear perspective view of a first embodiment of the handheld printer according to the present invention.

Referring now to FIG. 1, a first embodiment of the handheld printer 100 is shown. More specifically, FIG. 1 shows the handheld printer 100 in the middle of a print operation on a print medium 104 such as piece of paper placed on a flat surface 102. The handheld printer 100 includes a portable housing comprised of a top member 106, a front member 108, a bottom member 110 and a handle 112. These members 106, 108, 110 and 112 are joined together to form a generally O-shaped device. In another embodiment, the handheld printer 100 has a sideways U-shape without a front member 108. These shapes are provided only by way of example, as long as there is structure that is small in proportion to be handheld and offers areas for functionality that will be described above, various other structures are encompassed within the claimed invention. Each of these members 106, 108, 110 and 112 has a generally rectangular shape and different sizes as will be described in more detail below. The top member 106 has a generally rectangular shape with its rear side tapered to define a rectangular hole through which the scroll dial/scaling knob 114 protrudes. The top member 106 has an increased width at the top adapted for placement of a retractable display 120 (see FIGS. 2 and 3) upon this top surface. The handle 112 connects to the rear portion of the top member 106 to the rear portion of the bottom member 110. The handle 112 is sized and shaped such that it can be grasped by the human hand, such as about an inch in width and 3-4 inches in length. In particular, in one embodiment, the front wall of the handle 112 has four protrusions that define concave areas for receiving the user's fingers. The bottom member 110 has a width similar to the front member 108 and the handle 112. However, the bottom member 110 tapers outward to provide increased stability for movement of the handheld printer 100 across the paper 104 or other planar surface. The front member 108 couples the bottom member 110 to the top member 106 proximate the front of each member 106, 110. The front member 108 is provided to give the handheld printer 100 a more rigid and strong structure as well as to provide an area for storing consumables 808 (see FIG. 8) or electronics 804 (see FIG. 8).

Figure 2:
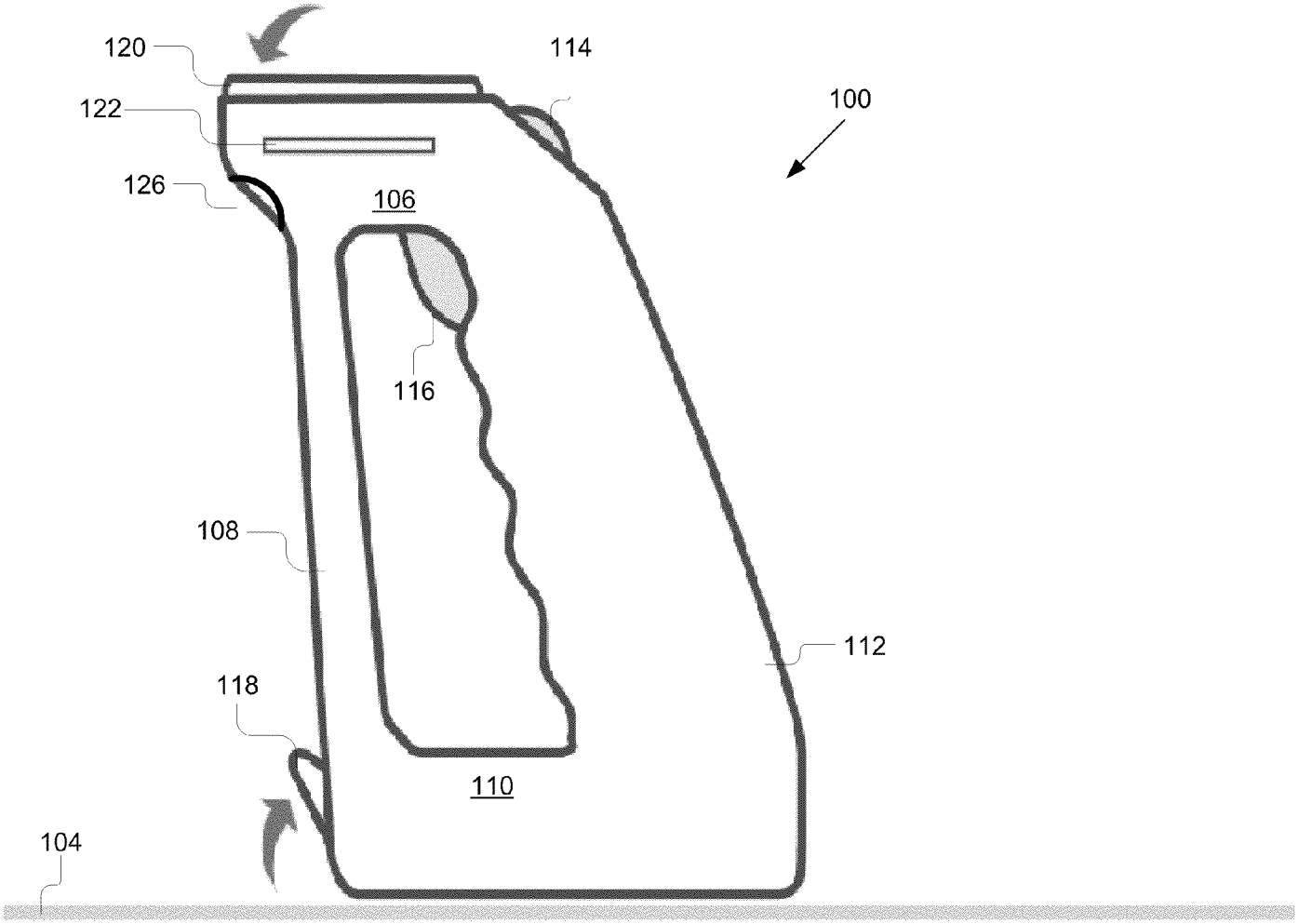
FIG. 2 is a side view of the first embodiment of the handheld printer according to the present invention with a display in a retracted position and a print head transitioning from a print position to a refracted position.

Referring now also to FIG. 2, the first embodiment of the handheld printer 100 will be described in more detail. FIG. 2 shows a side view of the handheld printer 100 in a nonprinting mode. This side view shows the scroll dial 114 as protruding from the rear side of the top member 106. The side view also shows how the top member 106 defines a slot 122 adapted to receive and couple with any portable media device 150 (See FIG. 3).

A portable media device 150 includes a memory card like a SD card, CompactFlash card or MD card as is typically used in digital cameras or portable music players; or a MediaKey which is a card containing an image and a barcode. The barcode has an ID and an encryption key that can be used to access and decrypt media stored on the Internet. In other words, the device can read the barcode on a (codename) MediaKey and download an encrypted image or document, decrypt it, and print it using the handheld printer.

FIG. 2 also shows the retractable display 120 in the retracted position, which is disposed flat upon the top surface of the top member 106. For example, the retractable display 120 could be coupled to the top member 106 by a spring loaded hinge mounted toward the rear top side of the top member 106 and the bottom rear side of the retractable display. FIG. 2 also illustrates a print button 116 that extends forward in a hole defined in part by the top member 106 and in part by the handle 112. The user can press the print button 116 using their index finger while at the same time holding and/or moving the handheld printer 112. Specifically, the button 116 is similar in design to a trigger on a gun. Proximate the front of the bottom member 110, a cavity is defined to house the print head 118. FIG. 2 illustrates the print head 118 in a transition from a first, printing position to a second retracted position. Finally, a projector 126 is disposed proximate the front side of the top member 106. The projector 126 is capable of projecting an image on the paper 104 or the surface 102. In one embodiment, the image projected by the projector 126 is adjustable responsive to user manipulation of the scroll dial 114. The projector 126 may be any one of a conventional type such as provided by a micro-projector; a projector by Blue Light Optics of Cambridge, England; and a MEMS laser projection module by Fraunhofer.

Figure 3:
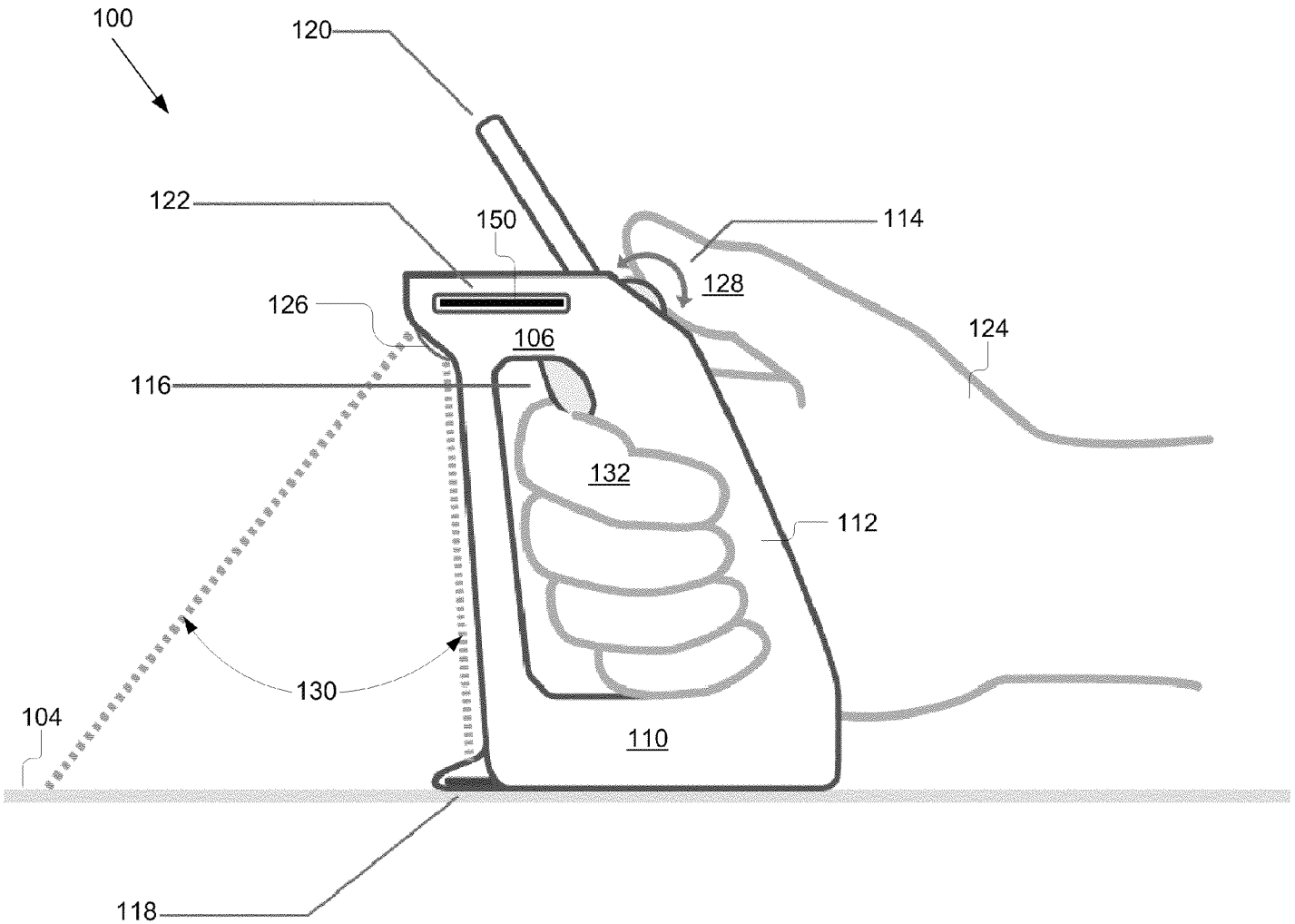
FIG. 3 is a side view of the first embodiment of the handheld printer according to the present invention with a display in a second position and the print head in the first position.

Referring now to FIG. 3, an embodiment of the handheld printer 100 in a printing mode is shown. FIG. 3 also shows a user's hand 124 and how it interacts with the handheld printer 100. In the printing mode, the display device 120 moves from the retracted position adjacent to the top surface of the top member 106 to an angled position where the angle between the top surface of the top member 106 and the bottom surface of the display device 120 is an acute angle. Repositioning the display device 120 at the angled position makes the display more easily viewable by the user. The user uses their thumb 128 to manipulate the scroll dial 114. The scroll dial 114 can be rolled forward or backward by the user's thumb 128 to adjust the size and position of the projected image. In contrast to FIG. 2, the print head 118 is fully extended and its front edge is adjacent to the paper 104 to apply ink. As illustrated by the dotted lines 130, the projector 126 of the handheld printer 100 advantageously projects an image on the paper 104 with the boundaries depicted by the dotted lines 130. During the print operation, the user uses their index finger 132 to depress the print button 116. In response to selection of the print button 116, the handheld printer 100 outputs ink via the print head 118 on the paper 104. In one embodiment, the print button 116 has two positions, a first position, partially depressed at which the projected image is "locked." In the "locked" mode, the printer 100 adjusts the appearance of the image projected to account for movement of the printer 100, so that regardless of the movement the projection onto the paper 104 has a constant appearance. If the user continues to depress the print button 116 to a second position, the projection continues be "locked" but the printer also performs the printing operation and outputs ink.

Figure 4A:
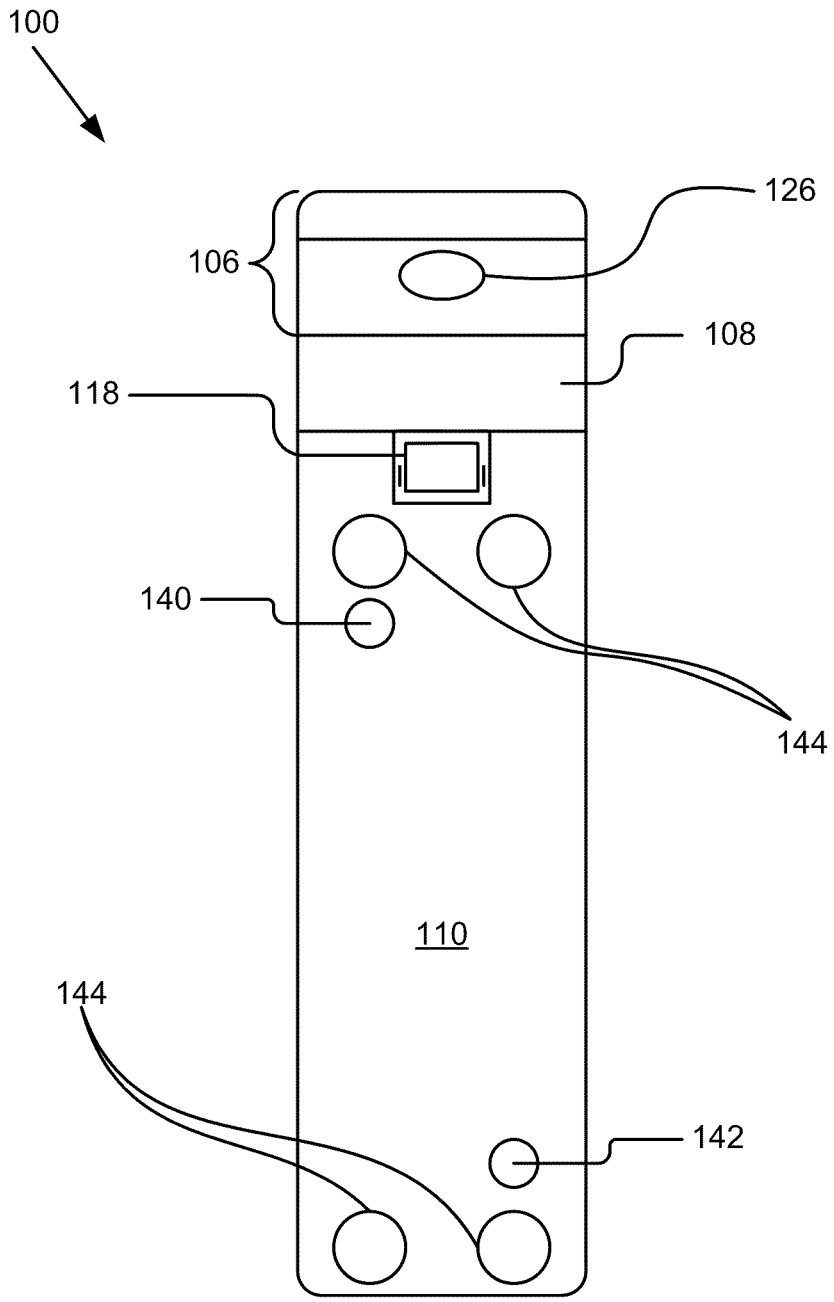
FIG. 4A is a bottom plan view of the first embodiment of the handheld printer according to the present invention.

Referring now also to FIG. 4A, a bottom plan view of the handheld printer 100 is shown. The bottom plan view of the handheld printer 100 shows the bottom of the bottom member 110, the front side of the front member 108 and a portion of the bottom of the top member 106. It should be noted that FIG. 4A illustrates the print head 118 in the retracted position. In the print position, the print head 118 would extend into an area shown in FIG. 4A as the front member 108. As can be seen from FIG. 4A, the bottom member 110 defines a plurality of apertures for position detection sensors 140, 142, rollers 144 and the print head 118. The handheld printer 100 advantageously provides a plurality of rollers 144 so that the handheld printer 100 may be placed upon the print medium 104 or other planar surface and moved easily across it. In this embodiment, the handheld printer 100 has four rollers positioned proximate the corners of the bottom side of the bottom member 110. In an alternative embodiment, the function of the rollers is provided by the position detection sensors 140, 142 or the bottom member 110, and there are no distinct rollers. The handheld printer 100 advantageously provides absolute position sensors 140, 142 for detecting movement and determining the position of the handheld printer 100. Collectively, these two absolute position sensors 140, 142 create a two-dimensional sensor. Those skilled in the art will recognize that more than two sensors 140, 142 could alternatively be used to create the two-dimensional sensor. In one embodiment, the absolute position sensors 140, 142 are optical sensors. In another embodiment (See FIG. 4B), the absolute position sensors 160, 162 are mechanical sensors such as trackball mice. For example, each absolute position sensor 160, 162 is a mechanical trackball mouse with at least 300 dpi and preferably 400 dpi and 1% accuracy. In this embodiment (referring back to FIG. 4A), two sensors 140, 142 are provided. The first sensor 140 is positioned on the bottom of the bottom member 110 proximate the front left side. The second sensor 142 is positioned on the bottom of the bottom member 110 proximate the rear right side. The sensors 140, 142 are provided so that the movement of the handheld printer 100 across the surface 102 or print medium 104 can be detected and the projection of the image being printed can be adjusted when in the "locked" mode. The aperture for the print head 118 is provided centered along the front edge of the bottom member 110.

Figure 4B:
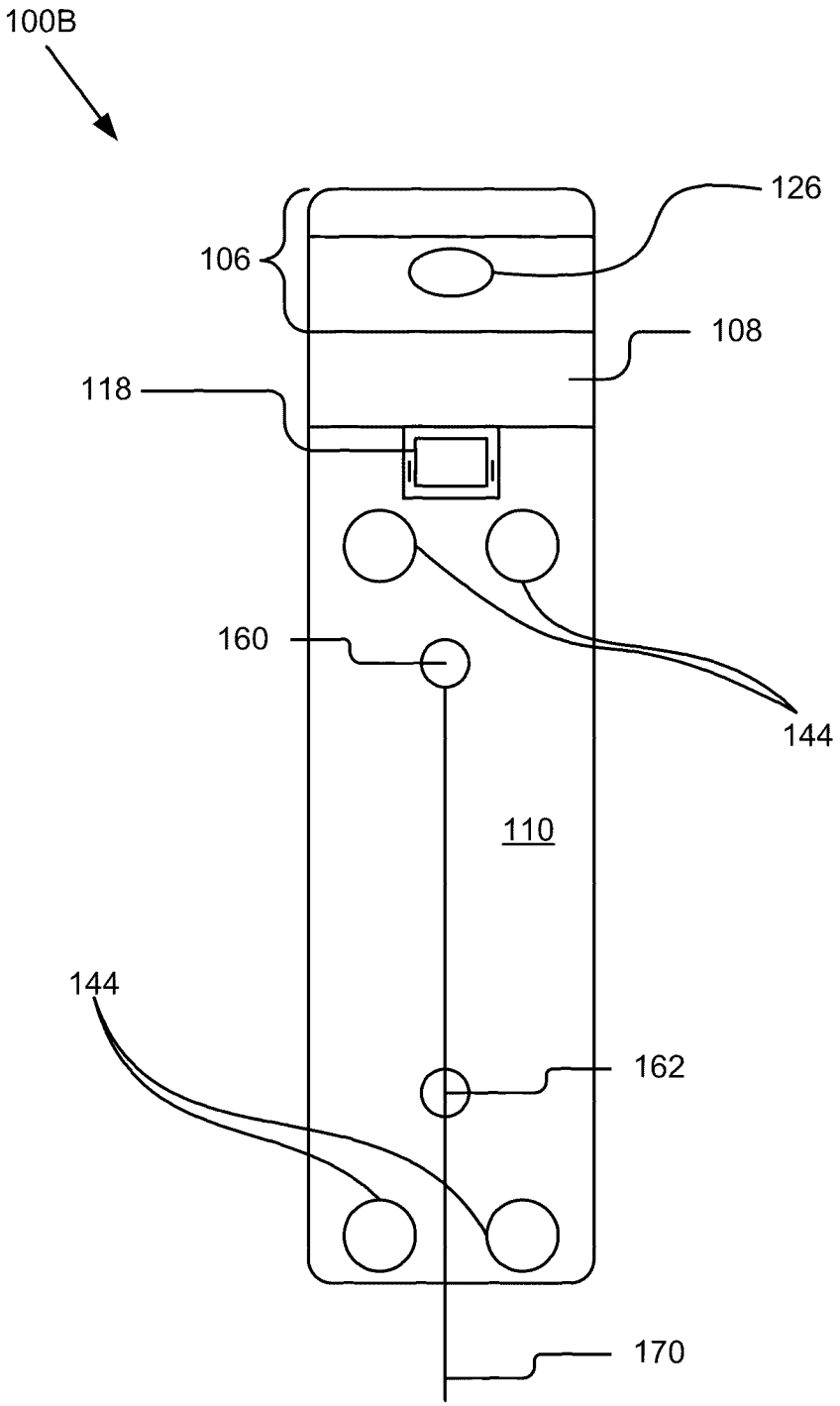
FIG. 4B is a bottom plan view of another embodiment of the handheld printer according to the present invention.

Referring now also to FIG. 4B, a bottom plan view of another embodiment of the handheld printer 100 is shown. The embodiment of the handheld printer 100 shown in FIG. 4B has many of the same or similar components as the embodiment described above and shown in FIG. 4A. Thus, like reference numbers and names have been used for components having the same or similar functionality. The bottom plan view of this embodiment of the handheld printer 100 again shows the bottom of the bottom member 110, the front side of the front member 108 and a portion of the bottom of the top member 106 with the print head 118 in the retracted position. As can be seen from FIG. 4B, the bottom member 110 defines a plurality of apertures for absolute position sensors 160, 162, the rollers 144 and the print head 118. The handheld printer 100 advantageously provides absolute position sensors 160, 162 for detecting movement and determining the position of the handheld printer 100. As shown in FIG. 4B, the absolute position sensors 160, 162 are placed spaced apart on the bottom along the longitudinal axis of the handheld printer 100 represented by the dashed line 170. As shown, the absolute position sensors 160, 162 are located on the centered longitudinal axis, but in other embodiments could be positioned on either side of the center. The absolute position sensors 160, 162 are position apart at a predefined distance such that the granularity of the theta value is provided. In one embodiment, the distance that the absolute sensors 160, 162 are positioned apart is selected such that determining position and rotation can be performed using division by powers of two. For example, the absolute position sensors 160, 162 are spaced apart by 4096/3 ticks from each other (center to center), which is approximately 3.5". Thus, a multiplication by three and shift by 12 accomplish a divison by 4096. It should also be noted that the output of the sensors 160, 162 are sent to the components of the handheld printer 100 every sensor tick.

Figure 16:
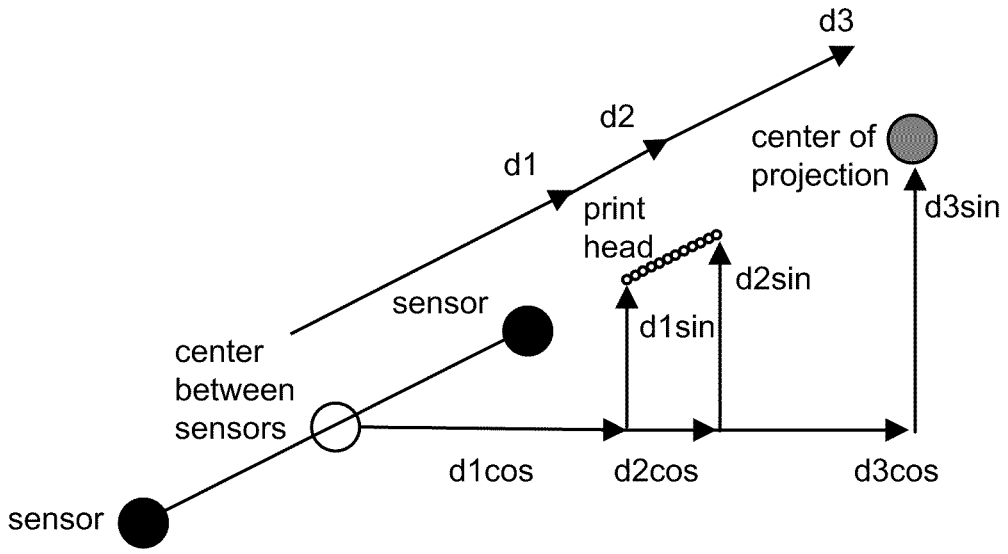
FIG. 16 is a diagram showing the transformation of position data to image coordinates according to the present invention.

As noted above, the present invention advantageously places the absolute position sensor 160, 162 at predefined locations to simplify the processing of position and rotation information and its transformation to image coordinates used for printing and projection. Referring now also to FIG. 16, a diagram showing the transformation of position data to image coordinates according to the present invention will be described. The absolute position sensor 160, 162, the print head 118 and the center of the projection are in a line as shown in FIG. 16 below. The absolute position sensors 160, 162 give information about both the position and rotation angle of the handheld printer 100 with respect to its initial position and angle. The information from the controller 1106 (See FIG. 11) attached to absolute position sensors 160, 162 is processed as follows. The center position (between the sensors 160, 162) at high resolution is read (for example from the Position Computation Unit 1206):

x_reg y_reg

The position is converted to 404 DPI tick units:

$x=x_reg/4096$ $Y=y_reg/4096$

The angle information is read (for example from the Theta Computation Unit 1210):

sin_reg cos_reg theta1_reg theta2_reg

In one embodiment, the sin_reg, cos_reg and theta1_reg registers are coarse and are quantized to about 0.7 degrees. The theta2_reg value has fraction bits with 16 times more resolution in angle. The additional resolution in angle is used to increase resolution for sin and cos using a linear approximation. Recall that the slope of cos is −sin and the slope of sin is cos. The initial conditions are that the angle is n/2, sin is 1.0 and cos is 0.0. If cos_reg is positive, the angle information is computed with:

cos=cos_reg+(50*theta2_reg*sin_reg)/65536 sin=sin_reg−(50*theta2_reg*cos_reg)/65536 theta=theta1_reg−(theta2_reg+8)/16

If cos_reg is positive, the angle information is computed with:

cos=cos_reg−(50*theta2_reg*sin_reg)/65536 sin=sin_reg−(50*theta2_reg*−cos_reg)/65536 theta=theta1_reg+(theta2_reg+8)/16

The cos and sin values are the floating point values multiplied by 4096. The theta value is the angle in radians multiplied by 4096. Note that 0.7 degrees is approximately 0.012 radians and for 16 times more resolution, 0.012/16 is approximately 50/65536.

The following distance measurements are known:

from center between sensors to closest nozzle on print head is d1 (e.g. 1882 ticks)

from center between sensors to farthest nozzle on print head is d2 (e.g. 1954 ticks)

Also, the initial location of the image to print can be specified, for example:

x_initial=1900 y_initial=20

The position of the closest nozzle in the print head at image resolution (¼ of sensor resolution, 101 DPI) is:

$x_n0=-(x+x\ \text{initial}+((\cos*d1)/4096)/4$ $y_n0=(y+y_\text{initial}+((-\sin*d1)/4096)/4$ The position of the farthest nozzle in the print head (x_n11, y_n11) 118 is computed similarly using d2 instead of d1. In one embodiment, the print head 118 has twelve nozzles and the position of any of the other ten nozzles can be computed similarly. For a stable projected image, the distance from the center between sensors 160, 162 to the projection center (d3) should be used. If it is desired to project what is under the print head 118 at an offset, the distance to the center of the print head 118, (d1+d2)/2, is used.

$xp=((x_n1+x_n11)/2)*4*xscale-x_offset$ $yp=((y_n1+y_n11)/2)*4*yscale-y_offset$ where xscale and yscale are the ratio of the projector DPI to the sensor ticks-per-inch and x_offset and y_offset are half the size of the projected image (length of vector from the start of the image to the center of the image). In this embodiment of the present invention, all division is by a power of 2 and can be performed with shift operations.

Figure 5:
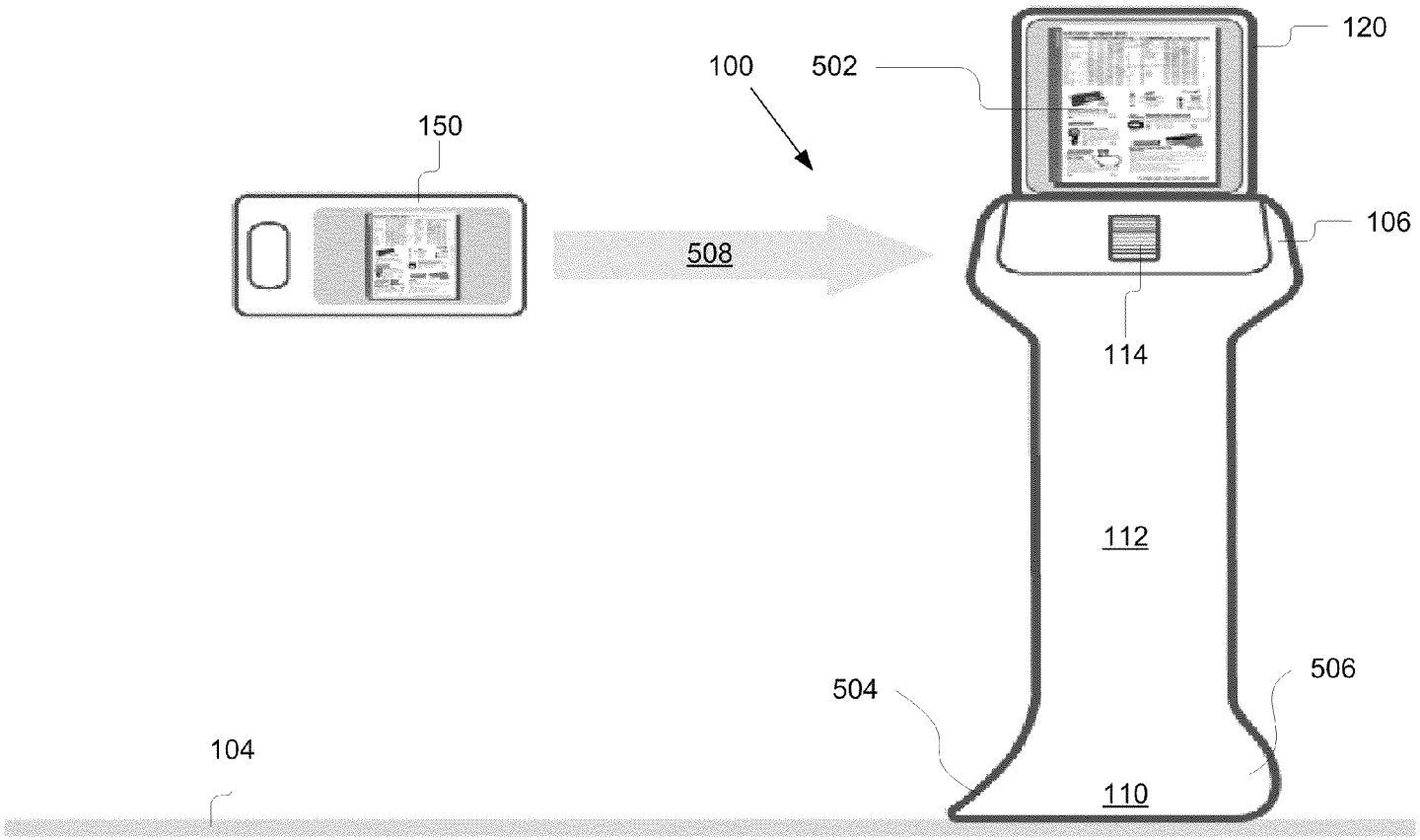
FIG. 5 is a rear side plan view of the first embodiment of the handheld printer according to the present invention.

Referring now to FIG. 5, a rearview of the handheld printer 100 is shown. For illustration purposes, a portable media device 150 shown. As illustrated by the arrow 508, the portable media device 150 can be inserted into slot 122 on the left side of the top member 106 of the handheld printer 100 (See also FIGS. 2 and 3). The portable media device 150 can include any image or data to be printed by the handheld printer 100. The portable media device 150 is just one example of a method for transferring print data from an external source to the handheld printer 100. FIG. 5 also illustrates the retractable display device 120 in the angled position. More specifically, the display device 120 shows any exemplary image 502 of the document to be printed. FIG. 5 also illustrates one embodiment of the left or trailing side 504 of the bottom member 110 and the right or front side 506 of the bottom member 110. These sides 504, 506 are advantageously shaped to provide increased stability when moving the handheld printer 100 across the surface 102 or print medium 104. The handheld printer 100 can be swept in either direction, and probably will be swept in both directions, during a single print and it is designed to be capable of such motion.

Although not shown by the exterior of the handheld printer 100 in this embodiment, the handheld printer 100 may also include other components such as communication devices such as wireless transceivers, USB and Bluetooth® transceivers, Infrared transceivers or image capture devices like a camera.

Figure 6:
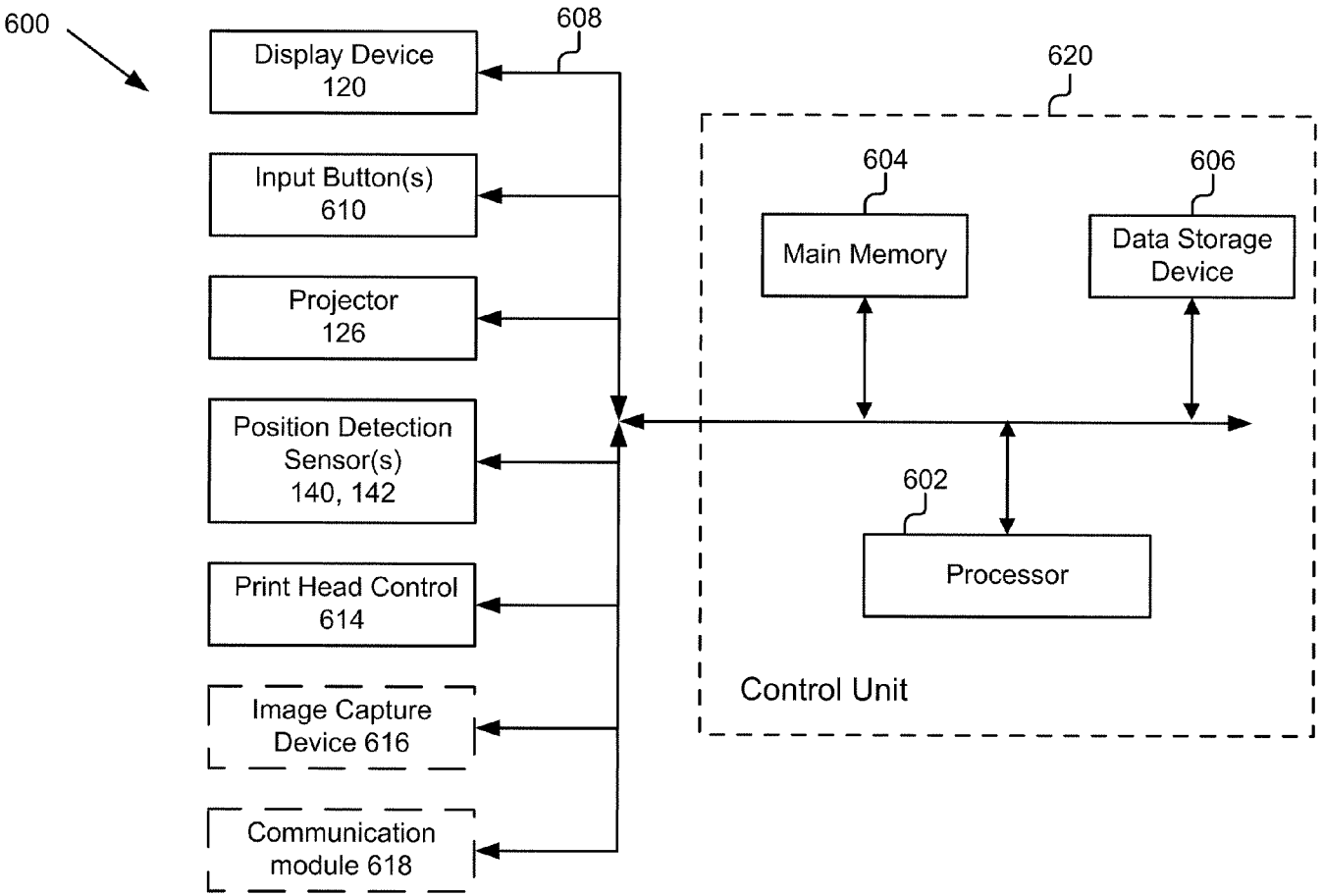
FIG. 6 is a block diagram of one embodiment of a computing system of the handheld printer in accordance with the present invention.

FIG. 6 is a block diagram of one embodiment of the computing system 600 housed by the handheld printer 100 and performing the methods of the present invention. The computing system 600 preferably comprises a control unit 620, a display device 120, one or more input buttons 610, the projector 126, position detection sensors 140, 142, and a print head control module 614. In other embodiments, the computing system 600 includes a camera or other image capture device 616, and a communication module 618 including transceivers or connectors.

The control unit 620 is shown including processor 602, main memory 604, and data storage device 606, all of which are communicatively coupled to system bus 608.

The processor 602 processes data signals and may comprise various computing architectures including a complex instruction set computer (CISC) architecture, a reduced instruction set computer (RISC) architecture, or an architecture implementing a combination of instruction sets. Although only a single processor is shown in FIG. 6, multiple processors may be included. The processor 602 comprises an arithmetic logic unit, a microprocessor, a general purpose computer, or some other information appliance equipped to provide electronic display signals to display device 120.

Main memory 604 stores instructions and/or data that may be executed by processor 602. The instructions and/or data may comprise code for performing any and/or all of the techniques described herein. Main memory 604 may be a dynamic random access memory (DRAM) device, a static random access memory (SRAM) device, Flash RAM (non-volatile storage), combinations of the above, or some other memory device known in the art. The memory 604 is described in more detail below with reference to FIG. 7.

Data storage device 606 stores data and instructions for processor 602 and comprises one or more devices including a hard disk drive, a flash memory device, or some other mass storage device known in the art. In an alternate embodiment, data storage 606 may be replaced by a connection to an external data storage unit.

The system bus 608 represents a shared bus for communicating information and data throughout control unit 620. System bus 608 may represent one or more buses including an industry standard architecture (ISA) bus, a peripheral component interconnect (PCI) bus, a universal serial bus (USB), I2C, SPI, or some other bus known in the art to provide similar functionality. Additional components coupled to control unit 620 through system bus 608 include the display device 120, one or more input buttons 610, the projector 126, the position detection sensors 140, 142, the print head control module 614, the image capture device 616, and the communication module 618.

Display device 120 represents any device equipped to display electronic images and data as described herein. Display device 120 may be, for example, an organic light emitting diode display (OLED), liquid crystal display (LCD), or any other similarly equipped display device, screen, or monitor. In one embodiment, display device 120 is equipped with a touch screen in which a touch sensitive, transparent panel covers the screen of display device 120. As has been noted above, in the preferred embodiment, the display device 120 is an OLED panel sized to the top member 106, and mounted for retractable positioning. In other embodiments, the display device may be a series of LEDs or other lights that indicate the status of the handheld printer 100.

The one or more input buttons 610 are any device to provide user input to the handheld printer 100 such as switches, cursor controller or a keyboard. In one embodiment, the input buttons include a print button 116, a scroll dial 114, a power button 812, a menu button 814 and a scaling knob 816. In one embodiment, the input buttons 610 can include an alphanumeric input device, such as a QWERTY keyboard, a key pad, or representations of such created on a touch screen, coupled to control unit 620 to communicate information and command selections to processor 602. In another embodiment, the input button 610 is a user input device equipped to communicate positional data as well as command selections to processor 602 such as a joystick, mouse, a trackball, a stylus, a pen, a touch screen, cursor direction keys, or other mechanisms to cause movement adjustment of an image.

The projector 126 outputs an image provided by the control unit 620. The projector 126 is capable of modifying the size and position of the image in response to signals from the control unit 620. The projector 126 is mounted to the portable housing of the handheld printer 100 as has been described above. The projector 126 is electrically coupled to the control unit 620 by bus 608. The projector 126 may be any one of a conventional type such as a micro-projector; a projector by Blue Light Optics of Cambridge, England; and a MEMS laser projection module by Fraunhofer. Moreover, the projector 126 is mounted to the housing of the handheld printer 100 so that its angle with respect to the target surface remains fixed as the printer 100 is rolled or slid along the surface 104.

The position detection sensors 140, 142 are coupled to the control unit 602 by the bus 608. One embodiment of the position detection sensors 140, 142 have been described above as optical sensors. In another embodiment, position detection sensors 140, 142 have been described above as mechanical sensors. While a plurality of sensors 140 and 142 are shown, those skilled in the art will recognize that other embodiments use only a single position detection sensor 140 that measures three degrees of freedom, including X and Y position and angular orientation. The position detection sensors 140 and 142 are used to track movement of the handheld printer 100 across the surface 102 or paper 104. The position detection sensors 140, 142 generate signals that are processed by processor 602 to determine an X-Y position of the handheld printer 100 on the surface 102 and include direction, speed and rotation of the handheld printer 100. This X-Y position data is used by the projection system to adjust the image projection information, and by the printing system to know where to drop ink material.

The print head control module 614 is coupled for the communication with the print head 118 and is used to control printing. More specifically, the print head control module 614 reformats and send signals to the print head 118 that cause it to move from the retracted position to the operational position, and vice versa. The print head control module 614 also signals to the print head 118 when to mark the print medium 104. Furthermore, the print head control module 614 can also be used as an interface to provide feedback to the processor 602 as to a printer head 118 malfunction or when consumables have run out, so that the user may be notified via the display device 120.

The image capture device 616 is preferably a digital camera and lens housed within the handheld printer 100. The image capture device 616 is coupled by bus 608 to send and receive control and status signals and to send captured images. For example, the image capture device 616 may include zoom, auto-focus and other camera capabilities. The image capture device 616 is any one of a conventional type such as those currently available in cellular phones and other small form factor devices, such as the ES2196M from ESS Technology, Inc. In one embodiment, the image capture device also includes an image processor (not shown). The image processor is used to detect a portion of the image that has been printed, and the image processor adapted for communication with the image capture device 616 and the control unit 620/processor 602. The image capture device 616 can be used to capture an image of the surface 104 and the image processor compares it to a source image. The difference between the captured image and the source image can then be used as an input to control marking of the surface 104.

The communication module 618 links control unit 620 to a network (not shown) and other processing systems. The network of processing systems may comprise a local area network (LAN), a wide area network (WAN) (e.g., the Internet), and/or any other interconnected data path across which multiple devices may communicate. In one embodiment, the communication module 618 is other conventional connections such as Ethernet, USB, etc. to other systems such as a network for distribution of files and information using standard network protocols such as TCP/IP, http, https, and SMTP as will be understood to those skilled in the art. One specific example has been described above as a portable media device slot/interface 122. In another embodiment, the communication module 618 is any one of conventional type of transceiver such as for Infrared communication, WiFi communication, 802.11 abg communication, Bluetooth® communication, 3G communication, or radio frequency communication. Those skilled in the art will recognize that other devices can be coupled to the bus 608 for interaction with the processor 602 in a variety of conventional ways.

It should be apparent to one skilled in the art that computing system 600 may include more or less components than those shown in FIG. 6 without departing from the spirit and scope of the present invention. For example, computing system 600 may include additional memory, such as, for example, a first or second level cache, or one or more application specific integrated circuits (ASICs). Similarly, additional components input/output devices may be coupled to control unit 620 including, for example, an RFID tag reader, digital still or video cameras, or other devices that may or may not be equipped to capture the target surface or portion of the document that has been printed. One or more components could also be eliminated such as camera 616 or communication module 618.

Figure 7:
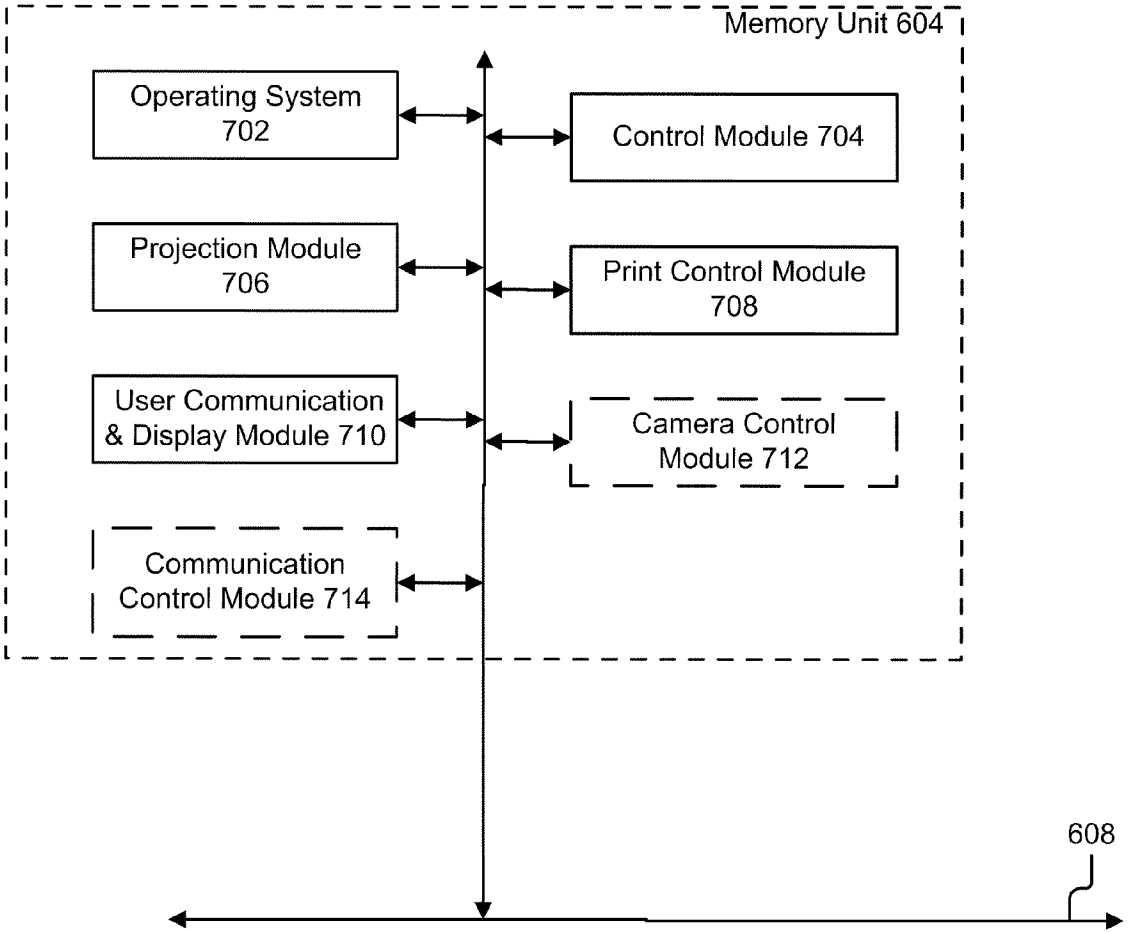
FIG. 7 is a block diagram of one embodiment of a memory for the computing system of the handheld printer in accordance with the present invention.

FIG. 7 is a block diagram of one embodiment of the memory unit 604 for the control unit 620. The memory unit 604 for the control unit 620 preferably comprises: an operating system 702, a control module 704, a projection module 706, a print control module 708, a user communication and display module 710, a camera control module 712, and an communication control module 714. As noted above, the memory unit 604 stores instructions and/or data that may be executed by processor 602. The instructions and/or data comprise code for performing any and/or all of the techniques described herein. These modules 702-714 are coupled by bus 608 to the processor 602 for communication and cooperation to provide the control unit 620. Those skilled in the art will recognized that while the present invention will now be described as modules or portions of a memory unit 604 of a computer system, the modules or portions thereof may also be stored in other media such as permanent data storage device 606 and may be distributed across a network having a plurality of different computers such as in a client/server environment and to which the hand held printer 100 is adapted for communication. Furthermore, those skilled in the art will recognize that the memory 604 includes areas for temporarily storing data and working memory area although not specifically shown.

The operating system 702 is preferably one of a conventional type such as, WINDOWS®, SOLARIS® or LINUX® based operating systems. Although not shown, the memory unit 604 may also include one or more application programs without limitation.

The control module 704 is used to control the other modules of the memory 604. The control module 704 is adapted for communication with the projection module 706, the print control module 708, the user communication and display module 710, the camera control module 712, and the communication control module 714. The operation of the control module 704 will be apparent from the description of FIGS. 8-9 below. The control module 704 is coupled to receive input from the input buttons 610, the position detection sensors 140, 142, camera 616 and communication module 618. The control module 704 also communicates and interacts to transfer data and commands with the display device 120, the projector 126, the print head control 614 and the communication module 618. While the control module 704 is shown as a separate module of the memory 604, those skilled in the art will recognize that the control module 704 in another embodiment may be distributed as routines in the other modules 706-714.

The projection module 706 is software used by the processor 602 for interacting with and controlling the projector 126 of the handheld printer 100. The projector 126 advantageously projects or outputs an image of the document to be printed. The projection module 706 sends the projector 126 signals that form the projected image, signals to adjust or modify the size of the projected image, the position of the projected image, brightness, contrast and other display characteristics by processor 602 responsive to input from the user. The image projected by the projector 126 is controlled by the processor 602 in accordance with the methods of the present invention. For example, using the input buttons 610 the user may adjust the display characteristics of the projector 126 to various different images displayed and seen by the user. In response to a lock input, the handheld printer 100 tracks its movement and automatically adjust the image projected so that is appears the same on the surface 104 as when the lock button 116 is initially depressed even though the position of the handheld printer 100 changes.

The print control module 708 is used to send commands from the user or processor 602 to the print head control 614. More specifically as has been note above, the print control module 708 sends signals to output ink, retract the print head 118 or move the print head to the operational position. The print control module 708 is also used to send status information from the print head 118 to the processor 602 for eventual presentation to the user of the handheld printer 100. The print control module 708 operates in conjunction with the processor 602 and is coupled by bus 608 for communication and interaction with the processor 602. The print control module 708 also optionally tracks and records when ink was output as the handheld printer 100 is moved. Thus, even in the handheld printer 100 is moved over the same point on the surface 104 multiple times to print the image, the print head 118 is selectively activated to output ink only a limited number of times (e.g. once or twice) for a given area of the surface. In other words, in one embodiment, regardless of how many times the user drags the handheld printer 100 over a particular region of the surface 104 that shows the locked and projected image, the handheld printer 100 deposits ink only on one pass over the particular region, and not on successive passes. Where ink had been output is monitored by the print control module 708, and the print control module 708 selective turn on and off the print head 118 so to ensure that ink is deposited only on one pass. In another embodiment, regardless of how many times the user drags the handheld printer 100 over a particular region of the surface 104, the handheld printer 100 deposits ink only on a maximum of two passes over the particular region.

The user communication and display module 710 is used to interact with the user and causes information to be displayed on the display device 120, and signals to be received from the input button 610. The user communication and display module 710 is capable of causing an image of the document to be printed to be generated and presented on the display device 120. The user communication and display module 710 is also capable of causing the processor 602 to display operational status information on the display device 120 such as whether the projected image is locked, whether printing is occurring, status of the print head 118 or consumables 808 (See FIG. 8), etc. The user communication and display module 710 also receives and processes signals from the input buttons 610 as has and will be described. These inputs cause initiation of other routines of the present invention.

In the embodiments where an image capture device 616 is included, the memory 604 also includes a camera control module 712. The camera control module 712 is software that allows the processor 602 to control the image capture device 616 and its capabilities including controlling the image that is captured and when the image is captured. In one embodiment, the camera control module 712 also processes the captured image, and stores it in the data storage device 606 or working memory. In another embodiment, the camera control module 712 also performs image processing.

In the embodiments where a communication module 618 is included, the memory 604 also includes the communication control module 714. The communication control module 714 is software adapted for communication with external devices (not shown) using the communication module 618. Regardless of communication format, the communication control module 714 manages the sending and receipt of commands, portions of files, files and data via the communication module 618.

Figure 8:
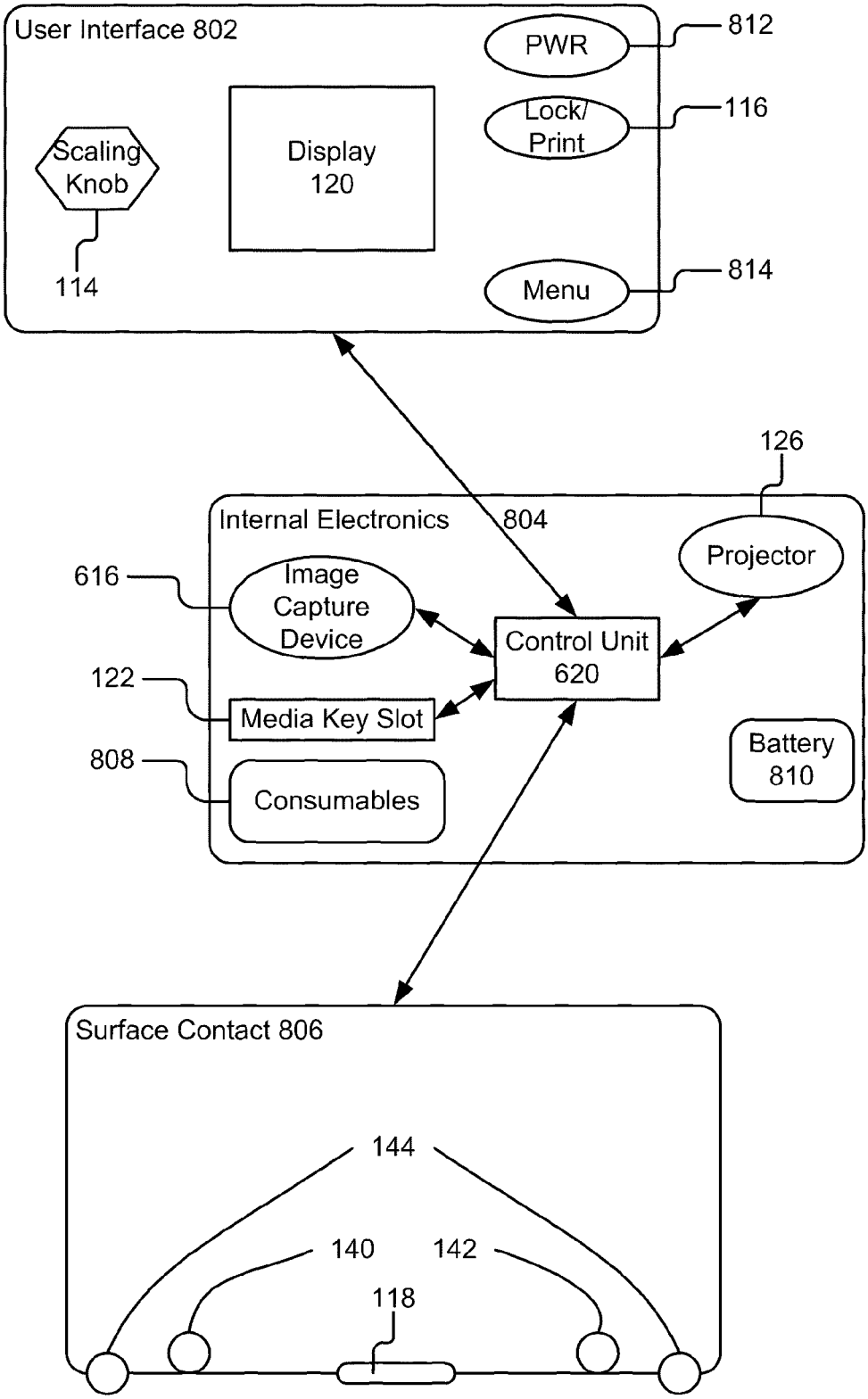
FIG. 8 is a conceptual block diagram of one embodiment of the handheld printer in accordance with the present invention.

Referring now to FIG. 8, a conceptual block diagram of another embodiment of the handheld printer 100 in accordance with the present invention is shown. The conceptual block diagram of FIG. 8 shows the relationships between the different components of the handheld printer 100 described above. More specifically, the user interface 802 for the handheld printer 100 includes a scaling knob 114, the display 120, a power button 812, the lock button 116, the print button 116 and a menu button 814. The display 120, the lock button 116 and the print button 116 have been described above so that description will not be repeated here. The scaling knob 114 allows the user to adjust the size and position of the projected image. In response to manipulation of the scaling knob 114, the processor 602 generates signals to adjust the image and sends them to the projector 126. In this embodiment, the power button 812 is provided to turn the handheld printer 100 on and off. This embodiment also provides a menu button 814 that allows the user to show additional information on the display 120. In response to selection of the menu button 814, the processor 602 shows status information and selectable options on the display device 120. The selectable options can be selected using the scaling knob 816. In yet another embodiment, the scroll dial 114 combines the functionality described above for the scaling knob 816 and the lock button 116. The scroll dial 114 can provide the scaling on input, but also can be pushed inward by the user into the housing of the handheld printer 100 to serve as the lock button 116.

The user interface 802 and its components are adapted for communication with internal electronics 804, in particular, the control unit 620. The internal electronics 804 include the image capture device 616, the portable media device slot 122, consumables 808, the control unit 620/processor 602, the projector 126 and a battery 810. The camera 616, the portable media device slot 122, the control unit 620/processor 602 and the projector 126 have been described above so that description will not be repeated here. The consumables 808 include ink or other material output by the handheld printer 100. The battery 810 is a conventional type, is stored within the housing, and provides power for operation of the computing system 600 and other components.

The internal electronics 804 are adapted for communication and control of surface contact components 806 which include absolute position sensors 140, 142 rollers 144 and the print head 118. The operation of these components is been described above as well as their interaction with the control unit 620/processor 602.

Figure 9:
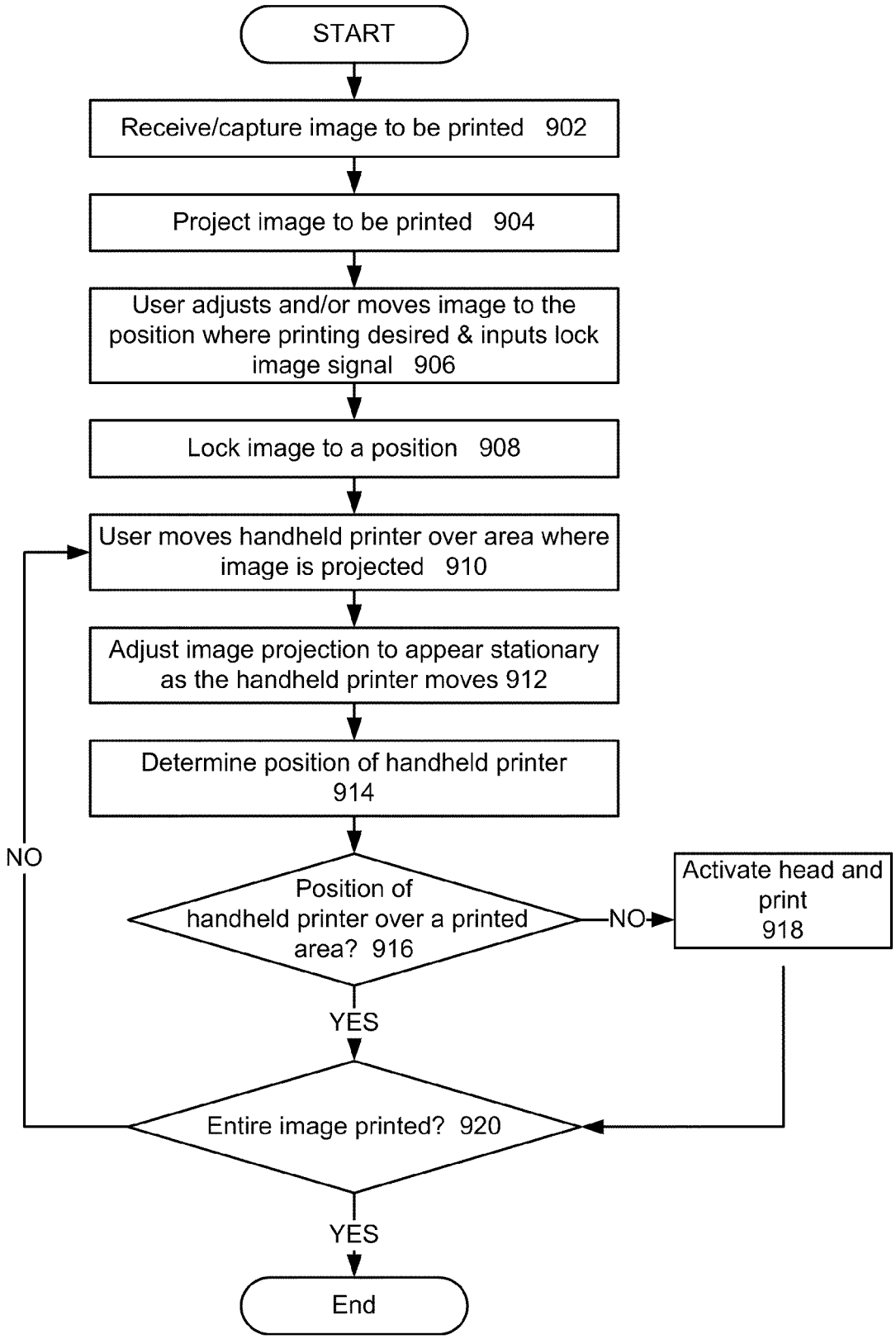
FIG. 9 is a flowchart of an embodiment of a method for printing according to the present invention using the handheld printer.

Referring now to FIG. 9, one embodiment of a method for printing with the handheld printer 100 according to the present invention will be described. The method begins with the handheld printer 100 receiving or capturing 902 an image to be printed. The handheld printer 100 can receive an image to be printed in response to the insertion of the portable media device 150 in the media slot 122. In another embodiment, the handheld printer 100 receives an image to be printed via the communication module 618 such as by coupling a memory card to a USB interface or similar interface, or by transmission of a file over an infrared or Bluetooth link. Additionally, where the handheld printer 100 includes the camera 616, the handheld printer 100 can perform a scan-to-print operation in which the camera 616 captures an image of the surface 104 or document then the handheld printer 100 is moved over a different blank surface and the image that was just captured is printed. Once the image to be printed has been captured or received 902, the method continues by projecting 904 the image to be printed using the projector 126 as illustrated above with reference to FIG. 3. Next, the user can adjust and/or move 906 the projected image to the desired position of where the document should be printed. The user can physically move the handheld printer 100 to adjust the position of the projected image. The user can also use the scroll dial 114, scaling knob 816 or other input buttons 610 to modify how the image is projected such that the projected image is in the desired position of where the document should be printed. Once the projected images in the desired position, the user inputs 906 the lock image signal by selecting one of the input buttons 610 or by pressing the lock/print button 116 half way down. The handheld printer 100 locks 908 the image to position and scale in response. Next, the user moves 910 the handheld printer 100 over the area where the image is being projected, and depresses the print button 116. Since the image is locked, the image projected by the handheld printer 100 is adjusted 912 for movement of the handheld printer 100 so that the projected image is stationary (fixed) on the surface 104 as the handheld printer 100 moves. The handheld printer 100 continuously determines 914 its position based on information from the absolute position sensors 140, 142. As the handheld printer 100 is being moved, the processor 602 determines whether the position of the handheld printer 102 is over an area that has already been printed. If not, the method proceeds to activate 918 the print head 118 and print or output ink after which the method continues at step 920. If the handheld printer 100 is over an area that is already printed of the method proceeds directly from step 916 to step 920. In step 920, the method determines whether the entire image has been printed. If not the method returns to step 910 where the user continues to move the handheld printer 100 over the area where the image is projected. In one embodiment, the handheld printer 100 provides feedback on the display 122 let the user know whether or not the entire image has been printed. If the entire image has been printed, the method is complete and ends.

Those skilled in the art will recognize that the projection of the image to be printed is particularly advantageous. For example, the image may be partially printed and then the handheld printer 100 may be set aside temporarily. The use of the projection is advantageous in this instance because the handheld printer 100 is able to print the remainder of the image with ease. The user need only project the image and manually, visually align the projected image with the partially printed image and then print the remainder of the image. The use of projection makes the realignment process particularly simple since it is very easy for the user to discern differences between the partially printed image and the projected image and thereby obtain precise and exact alignment.

Also, the user need not print the entire image shown by the projection. Instead, the user may choose to actually print only a portion of the projected image, which means they choose to print only a portion of their document. Maybe only one part of the document is particularly interesting to them. In this case, the projected image serves to show the entire image to the user, allowing the user to align the portion they're interested in on their target surface, and the user only needs to move the printer across the area of particular interest. This can be considered "instant cropping" of printed images. The projected image, combined with the flexibility of the handheld printer, allows cropping of images without needing to pre-process the print image data in some editing tool, such as in programs like PhotoShop by Adobe Systems Incorporated, of San Jose, Calif.

Figure 10:
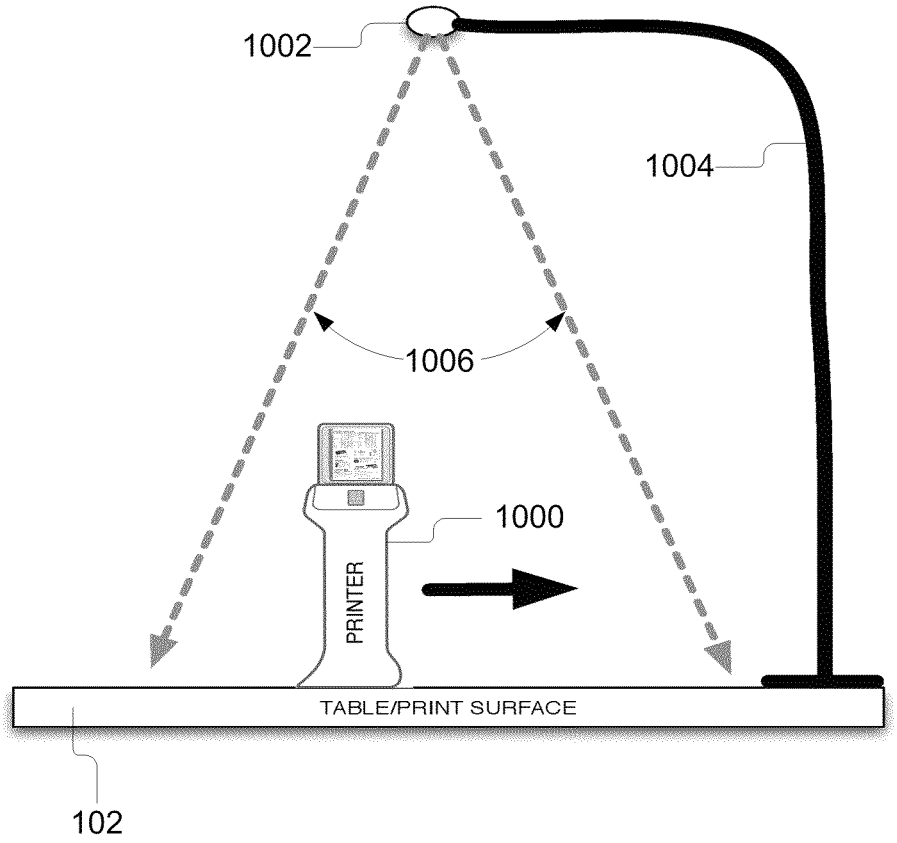
FIG. 10 is conceptual block diagram of a second embodiment of the handheld printer according to the present invention.

FIG. 10 shows a second embodiment of the handheld printer 1000 according to the present invention. In this second embodiment, the handheld printer 1000 does not include the projector. However, a projector 1002 is part of a desk or other structure of a room. The projector 1002 is coupled by a network 1004 to a communication device (not shown). The network 1004 is now the conventional type and could be connected for example to server (not shown). The handheld printer 1000 does include a communication module 618 as has been described above. The communication module 618 can send and receive information and commands to and from the projector 1002. The handheld printer 1000 uses the communication module to send an image to be printed to the network 1004 and in turn to the projector 1002. The projector 1002 receives and projects the image to produce projection 1006. The handheld printer 1000 is then moved across the print surface 104 as has been described above to print the image onto the surface 104. FIG. 10 illustrates one embodiment where the handheld printer 1000 has a reduced number of components but accesses components of pre-existing infrastructure to enable handheld printing in accordance with the present invention. Those of ordinary skill in the art will recognize that there are a number of permutations as to which components can be part of the handheld printer 1000 or part of the pre-existing infrastructure. For example, the camera 616 might also be part of pre-existing infrastructure similar to the projector 1002.

In another embodiment of the present invention, the print head is able to output two types of ink, one visible to the naked eye, and one in another spectrum such as an ultraviolet light spectrum. Alternatively, there may be separate print heads for the different types of ink. Regardless, the print head under control of the processor 602 is capable of applying registration marks visible in an ultraviolet light spectrum to the surface 104. In one embodiment, the handheld printer 100 includes an ultraviolet light source that may selectively be activated to reveal the registration marks. In another embodiment, the room projector 1002 includes the ultraviolet light source that may selectively be activated (via communication between the handheld printer 1000 and the projector 1002) to reveal the registration marks.

Referring now to FIGS. 11-15 and 4B, a third embodiment of the handheld printer 100C will be described. In particular, this third embodiment includes two-dimensional sensor hardware that converts mechanical input from the two absolute position sensors 160, 162 to digital two-dimensional coordinates, X, Y, angle (radians, sine, cosine). This two-dimensional sensor hardware is used in conjunction with a system and software to control the printing and projection of the image to be printed by the handheld printer 100C. This embodiment of the handheld printer 100C is particularly advantageous because the combination of the two-dimensional sensor hardware and the system minimize software operations by eliminating floating-point division and trigonometric calculations. This embodiment is also advantageous because a higher print quality is achieved by compensating for dot loss by using a print head dot smaller than an ideal pixel and printing each pixel twice if the print head passes over a region twice. Finally, this third embodiment of the handheld printer 100C is advantageous because of additional information projected that improves ease-of-use such as information for context, feedback, calibration and debugging.

Figure 11:
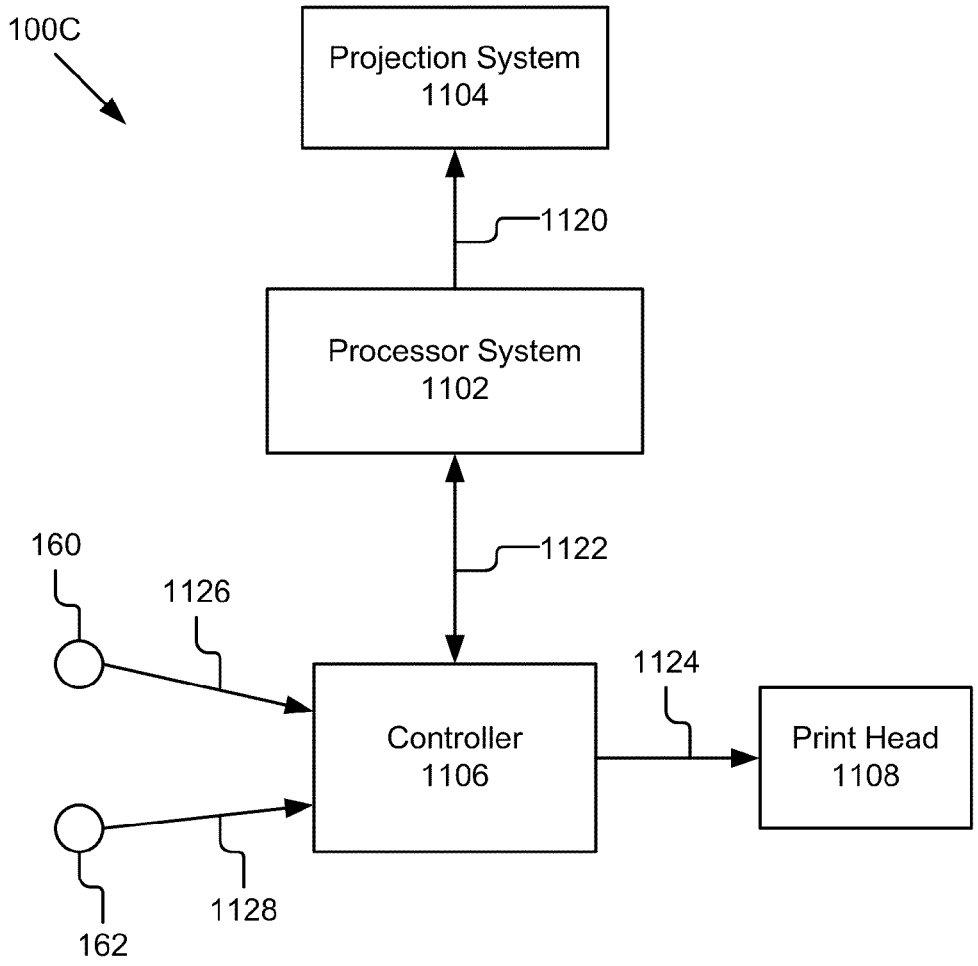
FIG. 11 is a block diagram of a third embodiment of the handheld printer according to the present invention.

Referring now to FIG. 11, a block diagram of the third embodiment of the handheld printer 100C will be described. This embodiment of the handheld printer 100C comprises a processor system 1102, a projection system 1104, a controller 1106, print head 1108, and the absolute position sensors 160, 162. Those skilled in the art will recognize that this third embodiment of the handheld printer 100C may include other components as has been described above with reference to other embodiments; however, the description of these components is not repeated here to avoid redundancy and for ease of understanding. For example, the processor system 1102 output signals for the control of LEDs as described in other embodiments above; however, that functionality will not be described below.

The absolute position sensors 160, 162 have been described above and detect the absolute position of the sensors 160, 162. The distance between the absolute position sensors 160, 162 is predefined and known. The absolute position sensors 160, 162 output quadrature encoding information. Absolute position sensor 160 is coupled by signal line 1126 to the controller 1106. Similarly, absolute position sensor 162 is coupled by signal line 1128 to controller 1106. The absolute position sensors 160, 162 send quadrature encoding information to be controller 1106 via the signal lines 1126, 1128.

The processor system 1102 is coupled to the projection system 1104 by signal line 1120. The processor system 1102 is also coupled to the controller 1106 via signal line 1122. The processor system 1102 controls the operation of the handheld printer 100C as will be described in more detail below with reference to FIGS. 14 and 15. More particularly, the processor system 1102 cooperates with the projection system 1104 and sends the projection system 1104 video information such as in a VGA format. The processor system 1102 also cooperates with the controller 1106 to control the activation of the print head 1108 and location tracking of the handheld printer 100C. In one embodiment, the processor system 1102 includes a microprocessor such as a Marvell PXA270 XScale or Texas Instruments OMAP, random access memory, read-only memory, a VGA interface, a USB host bus, and Ethernet interface.

The projection system 1104 has been described above with reference to FIGS. 3, 4, 5, 6, 7, 8, 9 and 10. The projection system 1104 is coupled to the processor system 1102 via signal line 1120 to receive information to the projected such as in a VGA format. The processor system 1102 provides the information to the projection system 1104 and the projection system 1104 outputs images corresponding to the receive information. The projection system 1104 and the processor system 1102 cooperate in unique ways to provide additional feedback to the user of the handheld printer 100C by inserting that information into the image projected by the projection system 1104. For example, the information output by the projection system 1104 response it to the processor system 1102 can include debugging information, calibration information, context, and feedback information. Examples of such information will be described in more detail and shown below with reference to FIG. 13.

The controller 1106 is coupled to the processor system 1102 for bidirectional communication via signal line 1122. The controller 1106 is also coupled via signal line 1124 to send print control signals to the print head 1108. In particular, the print head 1108 may include a plurality of nozzles and the controller 1106 provides signals to selectively activate one or more of the print nozzles. The controller 1106 is also coupled via signal lines 1126, 1128 to the absolute position sensors 160, 162, respectively. The controller 1106 receives quadrature encoding information from the absolute position sensors 160, 162 and determines the position of the handheld printer 100C. The controller 1106 receives and is responsive to control signals from the processor system 1102. The controller 1106 interfaces the processor system 1102 with the absolute position sensors 160, 162 and the print head 1108. The controller 1106 is also responsible for determining the position of the handheld printer 100C and storing it in position registers. The controller 1106 is described in more detail below with reference to FIG. 12.

The print head 1108 is similar to the print head 118 described above. The print head 1108 is coupled by signal line 1124 to the controller 1106. In one embodiment, the print head is an ink jet print head with an array of 12 separately controllable nozzles. Using the signal line 1124, the print head 1108 receives control signals from the controller 1106.

Figure 12:
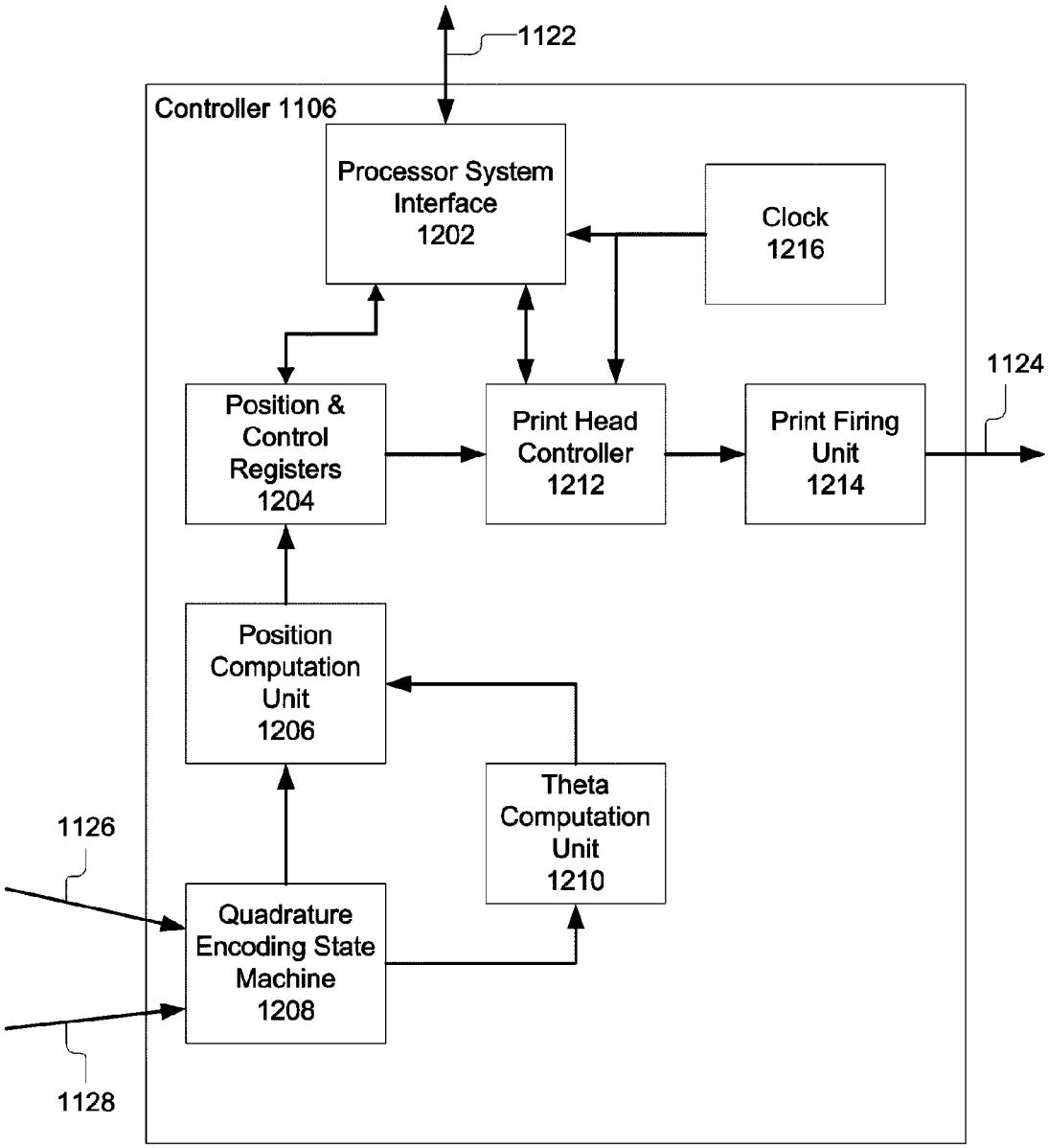
FIG. 12 is a block diagram of a controller for position determination and printed control for the third embodiment of the handheld printer according to the present invention.

Referring now to FIG. 12, a block diagram of an embodiment of the controller 1106 is shown in more detail. As has been noted above, the controller 1106 is responsible for position determination and printed control in the third embodiment of the handheld printer 110C. The controller 1106 comprises a processor system interface 1202, position and control registers 1204, a position computation unit 1206, a quadrature encoding state machine 1208, a theta computation unit 1210, a print head controller 1212, a print firing unit 1214, and a clock 1216.

The processor system interface 1202 is coupled to signal line 1122 to receive signals from the processor system 1102. The processor system interface 1202 is adapted to receive control signals from the processor system 1102 and uses them to control operation of the print head 1108 via signal line 1124. In one embodiment, the processor system interface 1202 receives the control signals, translates those control signals and stores them in the position and control registers. In another embodiment, the processor system interface 1202 is coupled to the print head controller 1212 to send the control signals that control operation of the print head 1108.

The position and control registers 1204 are convention processor or controller registers. The position and control registers 1204 store the position of the handheld printer 100C as a series of values each in a different register. In one embodiment, the position and control registers 1204 include a register for an X value, a Y value, a theta value, a cosine-theta value, sine-theta value. In one embodiment, each register is a 32-bit register which stores a fixed-point value with the apparent position of the radix point between 20 integer bits on the left and 12 fractional bits on the right. The decimal values are located in a lookup table. This is sufficient for accumulating X and Y positions. The position and control registers 1204 also include one or more registers for storing print control signals. The position and control registers 1204 are coupled to the processor system interface 1202 to receive and store control signals. The processor and control registers 1204 couple to the position computation unit 1206 to receive and store position signals. The position control registers 1204 are coupled to the printed controller 1212 to output the store values.

The quadrature encoding state machine 1208 is coupled signal lines 1126, 1128 to receive quadrature encoding information from the absolute position sensors 160, 162. The quadrature encoding state machine 1208 uses this information to produce position and rotation information. In one embodiment, the quadrature encoding state machine 1208 takes quadrature encoding information from the absolute position sensors 160, 162 (track balls) and increments (decrements) a "tick counter" based on that encoding. In one embodiment, the quadrature encoding state machine 1208 maintains four such "tick counters"—X0, Y0, X1, Y1—one counter for each direction for each absolute position sensors 160, 162. The output of the "tick counters" provides the output of the quadrature encoding sate machine 1208. The outputs of the four counters provide the values X0, Y0, X1, Y1 and are provided to the position commutation unit 1206. The outputs of the two counters provide the values X0 and X1 and are input to the Theta computation unit 1210.

The theta computation unit 1210 is coupled to receive the raw X position of the handheld printer 100C from the quadrature encoding state machine 1208 and generates angular information. The theta computation unit 1210 has an output coupled to the position computation unit 1206 to provide the angular information. In one embodiment, the theta computation unit 1210 receives signals from the X0 and X1 "tick counters" of the quadrature encoding state machine 1208 and computes angular information (rotational) of the base of the handheld printer 100C. It should be noted that the Y values do not play a role in defining this angle. The difference between X0 and X1, including the sign, is used to compute Theta, Cos-Theta, and Sin-Theta. In one embodiment, the computation unit 1210 is a 128-entry look-up table stored in internal read-only memory (ROM) and other control logic. The data for the lookup table is for Sin>0 and Cos>0 (quadrant 1). When Cos<0, the same lookup table is used, and appropriate signs are applied to the resulting data. The theta computation unit 1210 generates the values of Theta, Cos-Theta and Sin-Theta and provides them as input to the position competition unit 1206. The lookup table can be created using the following pseudo code:

for bin in 0 . . . 127:

Theta=bin*$n$/2 radians*4095/128

Cos-Theta=cos(bin*$n$/2 radians/128)*4095

Sin-Theta=sin(bin*$n$/2 radians/128)*4095

The position commutation unit 1206 receives values X0, Y0, X1, Y1 from the quadrature encoding state machine 1208 as has been described above. The position commutation unit 1206 also receives the values of Theta, Cos-Theta and Sin-Theta from the theta computation unit 1210 as just described. The position commutation unit 1206 maintains a cumulative count of absolute X and Y positions. X and Y become a function of the "tick counters" of the quadrature encoding state machine 1208 plus the trigonometric data based on the angle. Once the counters are zeroed, each tick effects X and Y, and they are accumulated by the position commutation unit 1206 as the handheld printer 100C is moved, according to the following equation (counter-clockwise):

$x$_new=$x$_previous+$dy$(cos-theta)+$dx$ (sin-theta)

$y$_new=$y$_previous+$dy$(sin-theta)−$dx$ (cos-theta)

And clockwise:

$x$_new=$x$_previous+$dy$(cos-theta)−$dx$ (sin-theta)

$y$_new=$y$_previous−$dy$(sin-theta)−$dx$ (cos-theta)

It should be noted that we are referenced to the Y-axis, not the X-axis, so signs in these equations are slightly different from the standard 2D transformation matrix. The initial starting condition is configured to be pointed along the Y vector straddling Quadrants 1 and 2 where: x=0; y=0; theta=pi/2; cos=0; and sin=1

Rotation is determined by a difference between X0 and X1. Change in X and Y is determined by:

$$dx=(X1_new+X0_new-X1_old-X0_old)/2; \text{ and}$$

$$dy=(Y1_new+Y0_new-Y1_old-Y0_old)/2.$$

The result is that if the handheld printer 100C is oriented mostly "north" (aligned with the Y axis), a large change along Y yields, a large change in Y-position. But if the handheld printer 100C has rotated so that it is oriented mostly "east" (with the X-axis), a large change along Y yields a large change in X-position.

The position commutation unit 1206 outputs the rotated, trigonometrically computed X and Y positions and stores them to the position and control registers 1204 so that they are readable by the processor system interface 1202 and the print head controller 1212.

The print control circuits (print head controller 1212, print firing unit 1214 and clock 1216) of the handheld printer 100C are advantageously separated from the processor system interface 1202 and the position computation circuitry. This allows the non-real-time nature of the CPU control to operate independently from the very specific timing requirements for the print head 1108.

The clock 1216 provides a "heartbeat" for controlling printing and in one embodiment is a 1 KHz clock signal generated by crystal oscillator such as part of a field program gate array.

The processor system 1102 treats each rising edge of the clock signal like a rising edge interrupt. At each interrupt, the processor system 1102 reads the position registers 1204 to determine if the handheld printer 100C is at a new location. If the location is unchanged, the processor system 1102 zeroes out control registers 1204 for the twelve of the ink jet head controls. This prevents any nozzles from being fired on the print medium. If the location is changed, the processor system 1102 determines which, if any, of the nozzles need to be fired to print a dot at the new position. The processor system 1102 stores 1's in the control registers 1204 corresponding to the array of 1-12 nozzles of the print head 1108 that need a drop and should be fired.

The print head controller 1212 reads the control registers to determine which if any nozzles of the print head 1108 should be fired. The print head controller 1212 is coupled to the clock 1216 to receive the clock signal, to the position and control registers 1204 to receive the position and control signals, and the print firing unit 1214 to send print signals. At the falling edge of the 1 KHz clock, the print head controller 1212 samples the control registers 1204 or alternatively the processor system interface 1202 to determine which nozzles to fire. Therefore, the processor system 1102 has half of a 1 KHz clock cycle to post updated nozzle firing data to the control registers 1204 or alternatively send signals via the processor system interface 1202. Once the print head controller 1212 samples or latches the nozzle firing data, it is provided to the print firing unit 1214. The print firing unit 1214 generates the explicit nozzle timing firing data required by the print head 1108. For example, in one the print head 1108 is ink jet head with 12 nozzles that can be fired in specific pairs, with a specific timing requirement of 4.5 usec active and 500 nsec between firing times. So the exact nozzles are fired very quickly with regard to the overall timing of the print interface. Firing consumes 30 microseconds (12 nozzles fired 2 at a time in 5 usec periods) out of a 1 KHz (1000 μsec) snapshot; this is only a 3% active timeframe. Thus, the processor system 1102 must be fast enough to respond to new position updates in this 1 KHz timeframe. Those skilled in the art will understand that there is an overall duty-cycle requirement depending on the type of the ink jet head utilized. Furthermore, when the handheld printer 100C is moved at a rate of 1 inch/second (a typical movement rate), 1 KHz provides the maximum dot resolution of 1000 dpi. The print head 1108 itself only supports 100 dpi (spacing of the nozzles), so the present invention can be adjusted to absorb tracking accuracy and firing trajectory issues.

Figure 13:
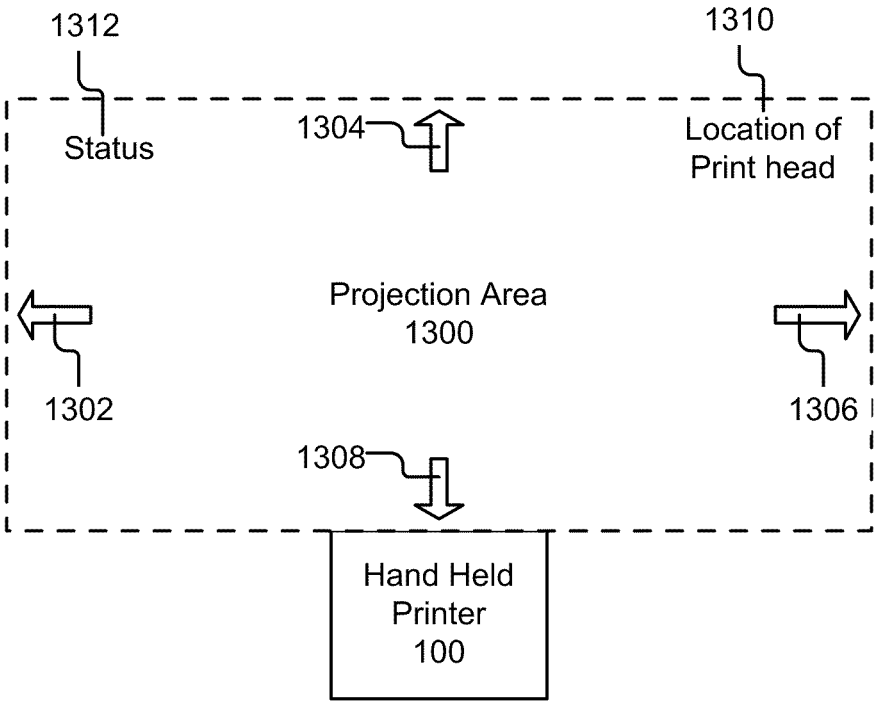
FIG. 13 is a block diagram of an embodiment of the handheld printer and his corresponding projection area according to the present invention.

Referring now to FIG. 13, a block diagram of an embodiment of the handheld printer 100 and its corresponding projection area 1300 according to the present invention are shown. The present invention is particularly advantageous because the improved position information provided by the absolute position sensors 160, 162 cooperates with the processor system 1102 and the projection system 1104 to allow for the projection of an image augmented with additional information to assist the user in operation of the handheld printer 100 of the present invention. In particular, the processor system 1102 and the projection system 1104 cooperate to cause the projection system 1104 to display additional information that is used to provide the user with a context or feedback. The projection system 1104 can also display additional information used for calibration or debugging. FIG. 13 illustrates an example projection area 1300 produced by the projection system 1104 the present invention. The projection area 1300 also includes augmented data 1302, 1304, 1306, 1308, 1310 and 1312 for any of the aforementioned purposes. Those skilled in the art will recognize that while these types of augmented data 1302, 1304, 1306, 1308, 1310 and 1312 are shown in FIG. 13, in actual use, the projection system 1104 may only display one of the pieces of augmented data. More specifically, the projection system 1104 is adapted to display one arrow 1302, 1304, 1306 and 1308 to provide the user with visual feedback. These arrows 1302, 1304, 1306 and 1308 are used to provide the user with context information, feedback or assistance to identify portions of the image that have not been printed, or a direction in which there are additional portions of the image which are not being projected. Another augmented projection 1312 is used to provide the user with visual feedback about the operational status of the handheld printer 100. For example, different icons or text may be projected to indicate that the handheld printer 100 is in printing mode, standby mode, locked mode, low on power, has completed printing or has additional information to print. The augmented data 1310 can also include portions that are projected for debugging the handheld printer 100 such as information about the location of the print head 118. Those skilled the art will recognize that the types of augmented data, the locations of the augmented data and the icons used in FIG. 13 are merely a few of the examples that can be used by the projection system 1104 to provide information about contacts, feedback collaboration for debugging to the user.

Figure 14:
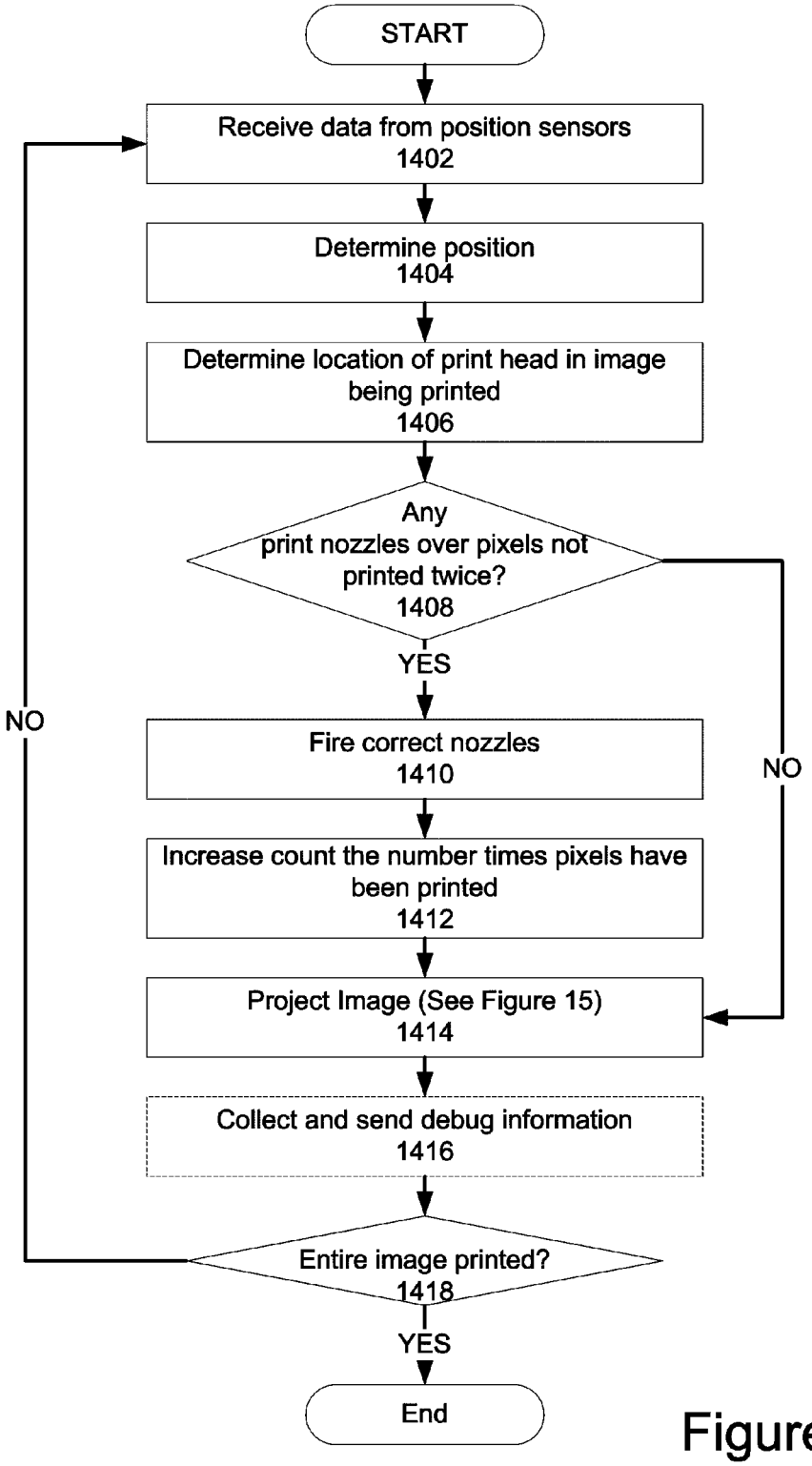
FIG. 14 is a flowchart of another embodiment of a method for printing according to the present invention using the handheld printer.

Referring now to FIG. 14, a method for printing according to the present invention using the third embodiment of the handheld printer 100C will be described. The method begins by receiving 1402 data from the absolute position sensors 160, 162. Then the method determines 1404 the position of the handheld printer 100C. For example, the quadrature encoded information from the absolute position sensors 160, 162 is converted to X and Y coordinates and rotational information as has been described above. Next the method determines 1406 the location of the print head 1108 in the image being printed. Then the method tests 1408 whether any of the print nozzles of the print head 1108 are over pixels that have not been printed twice. If all the print nozzles are over pixels that have been printed twice, the method proceeds to step 1414 as will be described below. However, if even one of the print nozzles is over a pixel that has not been printed twice, the method continues to fire 1410 the correct nozzles that have not been printed twice. As has been noted above, the present invention prints each pixel twice for improved image quality and to compensate for dot loss. After the correct nozzles have been fired, the method increases 1412 a count of the number of times the pixels have been printed. Then the method projects 1415 a new image. One embodiment for this step is described in more detail below with reference to FIG. 15. In an alternate embodiment as the picture by dashed lines in FIG. 14, the present invention may also optionally collect and send 1416 debugging information back to the processor system 1102. This information can be collected over time to identify modifications that need to be made to any part of the handheld printer 100C. For example, such debugging information may indicate that additional calibration of the projection system 1104 or the absolute sensors 160, 162 is required.

Figure 15:
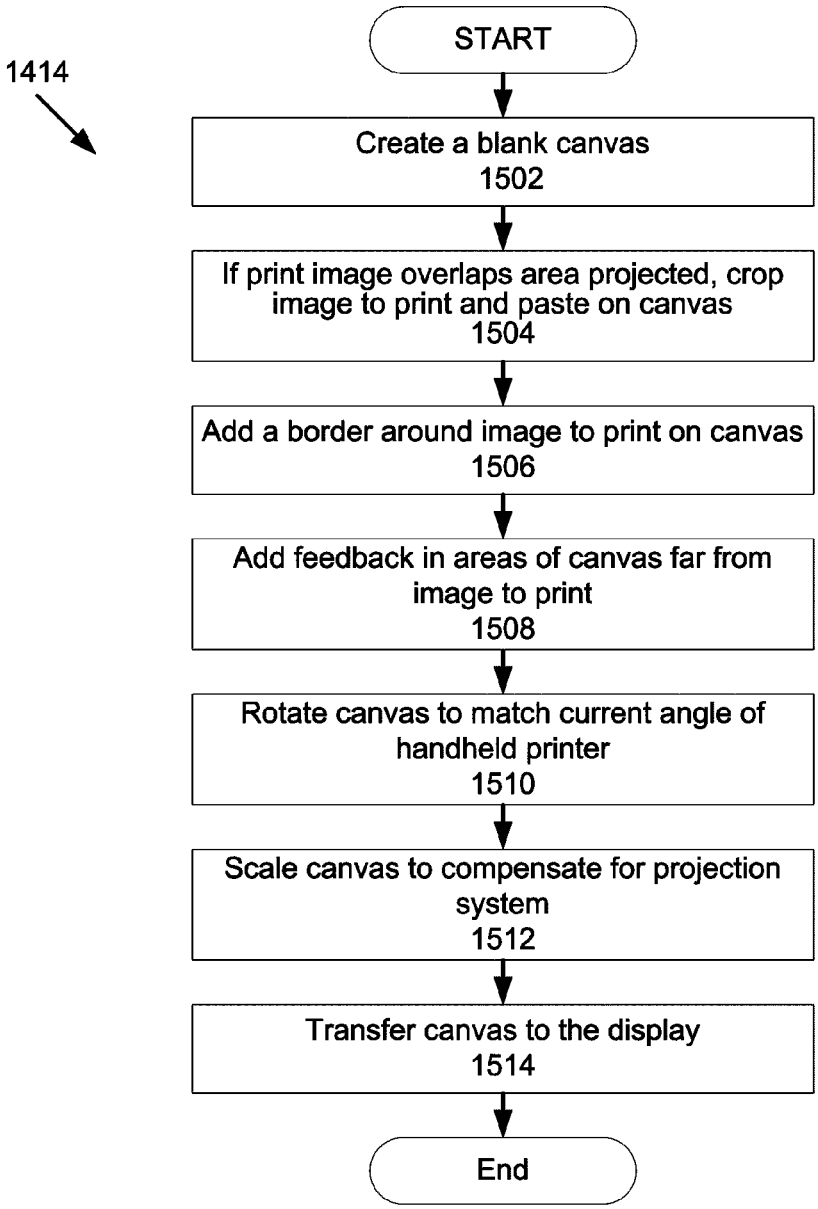
FIG. 15 is a flowchart of an embodiment of a method for projecting an image to be printed according to the present invention.

FIG. 15 is a flowchart of an embodiment of a method for projecting an image to be printed according to the present invention. The method begins by creating 1502 a blank canvas. Then the method determines 1504 whether the printed image overlaps with an area being projected. If so, the method crops a region of the image to print and paste it onto the canvas. Next the method adds 1506 a border around the image to print on the canvas. Then the method adds augmented information or feedback (i.e., arrows pointing to the printed image) in areas of the canvas that are far from the print image. Then the method rotates 1510 the canvas to match the current angle of the handheld printer 100. Next, the method scales 1512 the canvas to compensate for the projection system 1104. For example, the method scales the canvas to compensate for the projection system's 1104 non-square pixels. The method transfers 1514 the canvas to the display. In one embodiment, the processor system 1102 is a block image transfer of pixels to the projection system 1104 and then waits for the vertical blanking interval. Those skilled in the art will recognize that the method described above is merely one embodiment of a method for projecting an image to be printed by the handheld printer 100. In other embodiments, certain of the steps described above may be omitted or replaced place with the other steps.

The foregoing description of the embodiments of the present invention has been presented for the purposes of illustration and description. It is not intended to be exhaustive or to limit the present invention to the precise form disclosed. Many modifications and variations are possible in light of the above teaching. For example, the embodiments presented above with only one print head may be considered to be a monochrome printer (one color of ink). However, full color printing is possible by extending the presentation here to four print heads, as will be understood by those skilled in the art. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three. Of course, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

What is claimed is:

1. An apparatus for printing a document, the apparatus comprising:

a handheld, portable housing;

a plurality of absolute position sensors positioned apart at a predefined distance, the absolute position sensors to generate position information that includes a current position and a rotation angle of the apparatus with respect to an initial position and an initial angle based on absolute position sensor outputs and the distance between the absolute position sensors;

a controller mounted to the portable housing for controlling printing, the controller coupled to the plurality of absolute position sensors to receive the position information and use the position information in controlling printing;

a projector for projecting an image of the document to be printed on a target surface, the projector mounted to the portable housing, the projector coupled to the controller to adjust a projection of the image to account for a movement of the apparatus based on the current position and the rotation angle of the apparatus with respect to the initial position and the initial angle, the projection of the image maintaining a constant and stationary appearance of a projected image at a position of the target surface in response to the movement of the apparatus; and a print head for outputting ink in response to a signal from the controller, the print head mounted to the portable housing and coupled to the controller.

2. The apparatus of claim 1, wherein the plurality of absolute position sensors are one from a group of mechanical trackball mice or optical sensors with at least 300 dots per inch (dpi).

3. The apparatus of claim 1, wherein the plurality of absolute position sensors are positioned on a bottom of the handheld, portable housing and spaced apart on a longitudinal axis.

4. The apparatus of claim 1, wherein the projector is coupled to the controller to also:

receive a locking input from a user; and lock the projected image to maintain the constant and stationary appearance of the projected image at the position of the target surface in response to the locking input received from the user.

5. The apparatus of claim 1, wherein the plurality of absolute position sensors provide quadrature encoded information, and the controller determines a two-dimensional position of the apparatus as an X coordinate, a Y coordinate and an angle of rotation.

6. The apparatus of claim 1, wherein the controller includes a quadrature encoding state machine for receiving quadrature encoding information from the absolute position sensors and producing two-dimensional position information.

7. The apparatus of claim 1, wherein the controller includes a theta computation unit for receiving the position information and generating angular information, the theta computation unit including a look up table of angular values.

8. The apparatus of claim 1, wherein the print head includes a plurality of nozzles individually controlled to output ink, and wherein the controller sends a plurality of control signals to selectively cause one of the plurality of nozzles to output ink.

9. The apparatus of claim 1, wherein the controller sends control signals to the print head such that a plurality of pixels are printed by the print head twice.

10. A method for printing with a handheld printer, the method comprising:

projecting an image to be printed on a target surface;

detecting a movement of the handheld printer with a plurality of absolute position sensors positioned apart at a predefined distance;

generating position information that includes a current position and a rotation angle of the handheld printer with respect to an initial position and an initial angle based on absolute position sensor outputs and the distance between the absolute position sensors;

adjusting a projection of the image to account for the movement of the handheld printer based on the current position and the rotation angle of the handheld printer with respect to the initial position and the initial angle, the projection of the image maintaining a constant and stationary appearance of a projected image at a position of the target surface in response to the movement of the handheld printer; and outputting ink in response to the movement of the handheld printer.

11. The method of claim 10, wherein detecting the movement of the handheld printer with the plurality of absolute position sensors includes:

providing quadrature encoded information by the plurality of absolute position sensors; and determining a two-dimensional position of the handheld printer as an X coordinate, a Y coordinate and an angle of rotation.

12. The method of claim 10, wherein detecting the movement of the handheld printer with the plurality of absolute position sensors is performed once per sensor tick.

13. The method of claim 10, wherein detecting the movement of the handheld printer includes maintaining a tick counter that is responsive to quadrature encoding information from the plurality of absolute position sensors.

14. The method of claim 13, wherein one counter for each direction for each one of the plurality of absolute position sensors is maintained.

15. The method of claim 10 wherein outputting ink in response to the movement of the handheld printer is performed twice for a plurality of pixels.

16. The method of claim 10 wherein outputting ink has a print head dot smaller than an ideal pixel and a print head prints a plurality of pixels at once.

17. The method of claim 10 wherein projecting the image to be printed includes projecting augmented information onto the target surface.

18. The method of claim 17 wherein the augmented information is one from the group of context information, visual feedback, calibration information and debugging information.

19. The method of claim 17 wherein projecting the image to be printed includes rotating the projected image to match a current angle of the handheld printer.

20. The method of claim 17 wherein projecting the image to be printed includes scaling the projected image to compensate for a projection system of the handheld printer.

* * * * *